US010238208B2

(12) United States Patent
Henonin

(10) Patent No.: US 10,238,208 B2
(45) Date of Patent: Mar. 26, 2019

(54) MODULAR FOOD PRODUCT DISPLAY STAND

(71) Applicant: Sabritas S. de R.L. de C.V., Mexico City OT (MX)

(72) Inventor: Carolina Henonin, Mexico City (MX)

(73) Assignee: Sabritas S. de R.L. de C.V. (MX)

( * ) Notice: Subject to any disclaimer, the term of this patent is extended or adjusted under 35 U.S.C. 154(b) by 205 days.

(21) Appl. No.: 15/365,814

(22) Filed: Nov. 30, 2016

(65) Prior Publication Data

US 2018/0146777 A1 May 31, 2018

(51) Int. Cl.

| | |
|---|---|
| ***A47B 47/04*** | (2006.01) |
| ***A47B 87/00*** | (2006.01) |
| ***A47B 87/02*** | (2006.01) |
| *A47F 7/00* | (2006.01) |
| *A47F 10/02* | (2006.01) |

(52) U.S. Cl.

CPC ..... *A47B 47/047* (2013.01); *A47B 87/008* (2013.01); *A47B 87/0246* (2013.01); *A47B 47/045* (2013.01); *A47F 7/0071* (2013.01); *A47F 10/02* (2013.01)

(58) Field of Classification Search

CPC . A47B 47/047; A47B 87/0246; A47B 87/008; A47B 47/045; A47F 7/0071; A47F 10/02; B65D 21/0215; B65D 21/023

See application file for complete search history.

(56) References Cited

U.S. PATENT DOCUMENTS

| | | | | | |
|---|---|---|---|---|---|
| 2,665,174 | A | * | 1/1954 | Clarke | E04G 1/28 108/101 |
| 3,834,324 | A | * | 9/1974 | Lang | A47B 87/0246 108/190 |
| D269,672 | S | | 7/1983 | Seltzer | |
| D269,868 | S | | 7/1983 | Seltzer | |
| 4,523,681 | A | | 6/1985 | Kreeger | |
| 4,577,759 | A | | 3/1986 | Kreeger | |
| 5,158,187 | A | | 10/1992 | Taub | |
| 5,441,151 | A | * | 8/1995 | Billingham | A47B 63/00 206/425 |
| D383,339 | S | | 9/1997 | Grosfillex | |
| 5,722,544 | A | | 3/1998 | Williams | |
| 5,746,139 | A | * | 5/1998 | Villanueva | A47B 45/00 108/102 |

(Continued)

*Primary Examiner* — Ko H Chan

(74) *Attorney, Agent, or Firm* — Colin P. Cahoon; Samie S. Leigh; Carstens & Cahoon, LLP

(57) ABSTRACT

Disclosed are a modular food product display stand and a related method for constructing such display stand. Such display stand may comprise a plastic tray having four top corners, four bottom corners, top receiving slots located at each top corner, and bottom receiving slots located at each bottom corner. The display stand may further comprise four insertable plastic feet installed in the bottom receiving slots, and four insertable plastic posts installed in the top receiving posts. The outer dimensions of a cross-section of the plastic feet may match the inner dimensions of a cross-section of the bottom receiving slots, and the outer dimensions of a cross-section of the plastic posts may match the inner dimensions of a cross-section of the top receiving slots. The display stand may also comprise a plastic topper with receiving slots at each corner of the bottom of the topper for receiving the plastic posts.

45 Claims, 15 Drawing Sheets

(56) References Cited

U.S. PATENT DOCUMENTS

| | | | | |
|---|---|---|---|---|
| D414,588 | S | 9/1999 | Mires | |
| 7,036,666 | B2 * | 5/2006 | Hammett | B65D 1/22 206/503 |
| 7,066,342 | B2 * | 6/2006 | Baechle | B65D 5/006 206/600 |
| D557,011 | S | 12/2007 | Fernandez | |
| D615,777 | S | 5/2010 | Lee | |
| D637,022 | S | 5/2011 | Noble Colin | |
| 8,708,433 | B2 * | 4/2014 | Ahlgrim | A47B 43/02 312/108 |
| D754,458 | S | 4/2016 | Mason | |
| D759,998 | S | 6/2016 | Mason | |
| 9,428,298 | B2 * | 8/2016 | Bersamin | A47F 5/114 |
| D775,883 | S | 1/2017 | Mason | |
| 9,826,843 | B1 * | 11/2017 | Tomaszewski | A47F 5/114 |
| 2002/0070223 | A1 * | 6/2002 | Elvin-Jensen | B65D 11/10 220/669 |
| 2003/0183549 | A1 | 10/2003 | Verna | |
| 2005/0183980 | A1 | 8/2005 | Fernandez | |
| 2006/0070906 | A1 | 4/2006 | Verna | |
| 2006/0151410 | A1 * | 7/2006 | Lowry | A47F 3/142 211/126.16 |
| 2008/0128319 | A1 | 6/2008 | Noble Colin | |
| 2016/0007737 | A1 * | 1/2016 | Clark | B65D 21/0215 211/126.2 |

* cited by examiner

MODULAR FOOD PRODUCT DISPLAY STAND

BACKGROUND

1. Technical Field

The present disclosure relates generally to a food product display shelving system. More specifically, the invention relates to a modular food product display stand and a related method of constructing the modular food product display stand. This modular food product display stand can be constructed in any combination and arrangement of its component parts and accomplishes the goal of improved visibility and accessibility of food products while also improving construction time and increasing adaptability of the stand to multiple environments.

2. Description of Related Art

Retail display shelving commonly used in grocery stores, department stores, discount stores, and other retail outlets that display items on shelves are manufactured by numerous companies in a plethora of models and design choices. The units that are typically found in a grocery store to display items for sale, such as bags of salty snacks and other food products, include cardboard and corrugated plastic displays stands, which are all temporary modular displays.

Although there are variations amongst the temporary modular displays offered by different manufacturing companies, the basic design is fairly well established, and there are many common features shared industry wide. These temporary modular displays are flexible in design and construction. Because of their flexibility in design and construction, temporary modular displays can be made into a variety of shapes for various applications, and can be used as temporary displays or as permanent displays. Manufacturing of temporary modular displays does not cost as much as manufacturing other types of retail displays, and temporary modular displays can be assembled to incorporate a large display capacity for any type of product.

However, the temporary modular displays are lacking in some respects. Temporary modular displays are not very durable, because they are constructed from cardboard or corrugated plastic, and need to be replaced every four months. They do not always accommodate a full portfolio of products because despite the large display capacity, there are weight and size limitations based on the construction material of the displays. Temporary modular displays also require time for assembly and set up, and often times, instruction manuals are needed for assembling the displays. Temporary modular displays are generally not adaptable to what retail stores want or to store guidelines, and are also generally not adaptable or scalable to multiple situations.

Furthermore, temporary modular displays cause other difficulties. Customers sometimes have difficulty when attempting to remove items from the temporary modular displays because the temporary modular displays are usually tightly packed with food products and they are not designed for easy removal of products. Temporary modular displays may reduce product visibility because the displays require more area for structural support of the display, depending on the construction material. Temporary modular displays also do not have unified image, and come in all sorts of shapes and sizes that are usually thrown together spontaneously.

Nothing in the prior art addresses the problem of durability, construction cost, implementation flexibility, scalability, and adaptability with food product displays. Further, nothing in the prior art addresses the problem associated with maximizing the available retail space on a typical temporary modular display. Because retailers have a fixed amount of floor space with which to display retail merchandise, a need exists for an adaptable display stand for retail stores to customize as needed.

SUMMARY

The present disclosure provides a modular food product display stand and means for constructing the modular food product display stand. In one embodiment, a modular food product display stand constructed as disclosed herein may comprise a plastic tray having a top and a bottom, the top of the plastic tray having four top corners, the bottom of the plastic tray having four bottom corners, and a top receiving slot located at each top corner and a bottom receiving slots located at each bottom corner. The display stand may further comprise four insertable plastic feet installed in the bottom receiving slots of the plastic tray, and four insertable plastic posts installed in the top receiving slots of the plastic tray. With such an exemplary display stand, the outer dimensions of a cross section of the plastic feet may match the inner dimensions of a cross section of the bottom receiving slots, and the outer dimensions of a cross-section of the plastic posts may match inner dimensions of a cross-section of the top receiving slots. The cross-section of the plastic posts may substantially match the cross-section of the plastic feet. In addition, in exemplary embodiments, the display stand may comprise a plastic topper that may have a receiving slot at each corner of the bottom of the topper for receiving the plastic posts.

In other embodiments, a modular food product display stand constructed in accordance with the disclosed principles may comprise a plurality of plastic trays. Each tray of the plurality of plastic trays may have a top receiving slot at each corner of the top of the tray and a bottom receiving slot at each corner of the bottom of the tray. Each tray may also have a first set of middle receiving slots positioned adjacent to a first edge of the plastic tray and a second set of middle receiving slots positioned adjacent to a second edge of the plastic tray, and the first edge and the second edge may be parallel to each other. In exemplary embodiments, the display stand may further comprise a plurality of insertable plastic posts and a plurality of insertable plastic feet. The outer dimensions of a cross-section of the plastic posts may match inner dimensions of the top receiving slots of the plastic trays, and the outer dimensions of a cross-section of the plastic feet match inner dimensions of the bottom receiving slots of the plastic trays. In exemplary embodiments, a first subset of the plastic trays may be positioned adjacent to each other to form a base layer of plastic trays, and the insertable plastic feet may be installed into the bottom receiving slots of the first subset of plastic trays. Additionally, a first subset of the plastic posts may be installed into at least one of each set of middle receiving slots of each plastic tray of the first subset of plastic trays, by inserting the plastic posts into the middle receiving slots. Furthermore, in such embodiments, the first subset of plastic posts may also be inserted into the bottom receiving slots of each plastic tray of a second subset of plastic trays.

In another aspect, a method of constructing a modular food product display stand in accordance with the disclosed principles is also disclosed. In an exemplary embodiment, such a method may involve constructing a modular food product display stand that may comprise a plastic tray having a top with four top corners and a bottom with four bottom corners. A top receiving slot may be located at each top corner, and a bottom receiving slot may be located at each bottom corner. The modular food product corner may further comprise four insertable plastic feet that may be installed in the bottom receiving slots, and four insertable plastic posts that may be installed in the top receiving slots. The outer dimensions of a cross section of the plastic feet may match inner dimensions of a cross-section of the bottom receiving slots, and the outer dimensions of a cross section of the plastic posts may match inner dimensions of a cross section of the top receiving slots. The cross-section of the plastic posts may substantially match the cross-section of the plastic feet. Additionally, the modular food product display stand may further comprise a plastic topper with a receiving slot located at each corner of the bottom of the topper. The method of creating such a modular food product display stand may comprise inserting a first end of each of the four insertable plastic posts into one of the top receiving slots of the plastic tray. In such exemplary embodiments, a method may further include aligning a second end of each of the four insertable plastic posts into the receiving slots of the plastic topper; and inserting the second end of the plastic post into the receiving slots of the plastic topper.

Figure 1A:
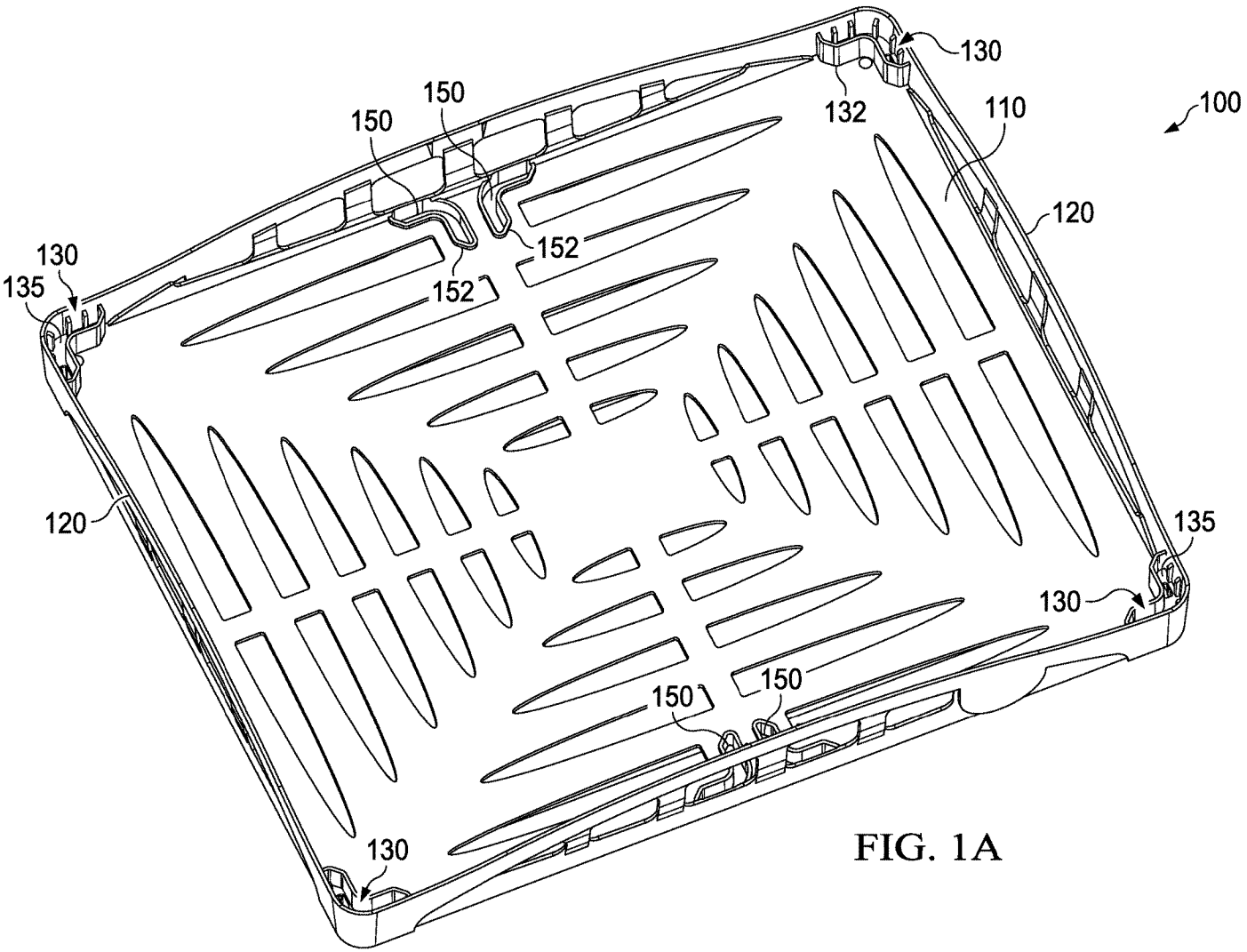
FIG. 1A is a top perspective view of one embodiment of a molded plastic tray of a modular food product display stand in accordance with the disclosed principles.

The above figures are provided for the purpose of illustration and description only, and are not intended to define the limits of the disclosed invention. Use of the same reference number in multiple figures is intended to designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION

In view of the foregoing, through one or more various aspects, embodiments and/or specific features or sub-components, the present disclosure is thus intended to bring out one or more of the advantages that will be evident from the description. The present disclosure makes reference to one or more specific embodiments by way of illustration and example. It is understood, therefore, that the terminology, examples, drawings and embodiments are illustrative and are not intended to limit the scope of the disclosure.

Figure 1B:
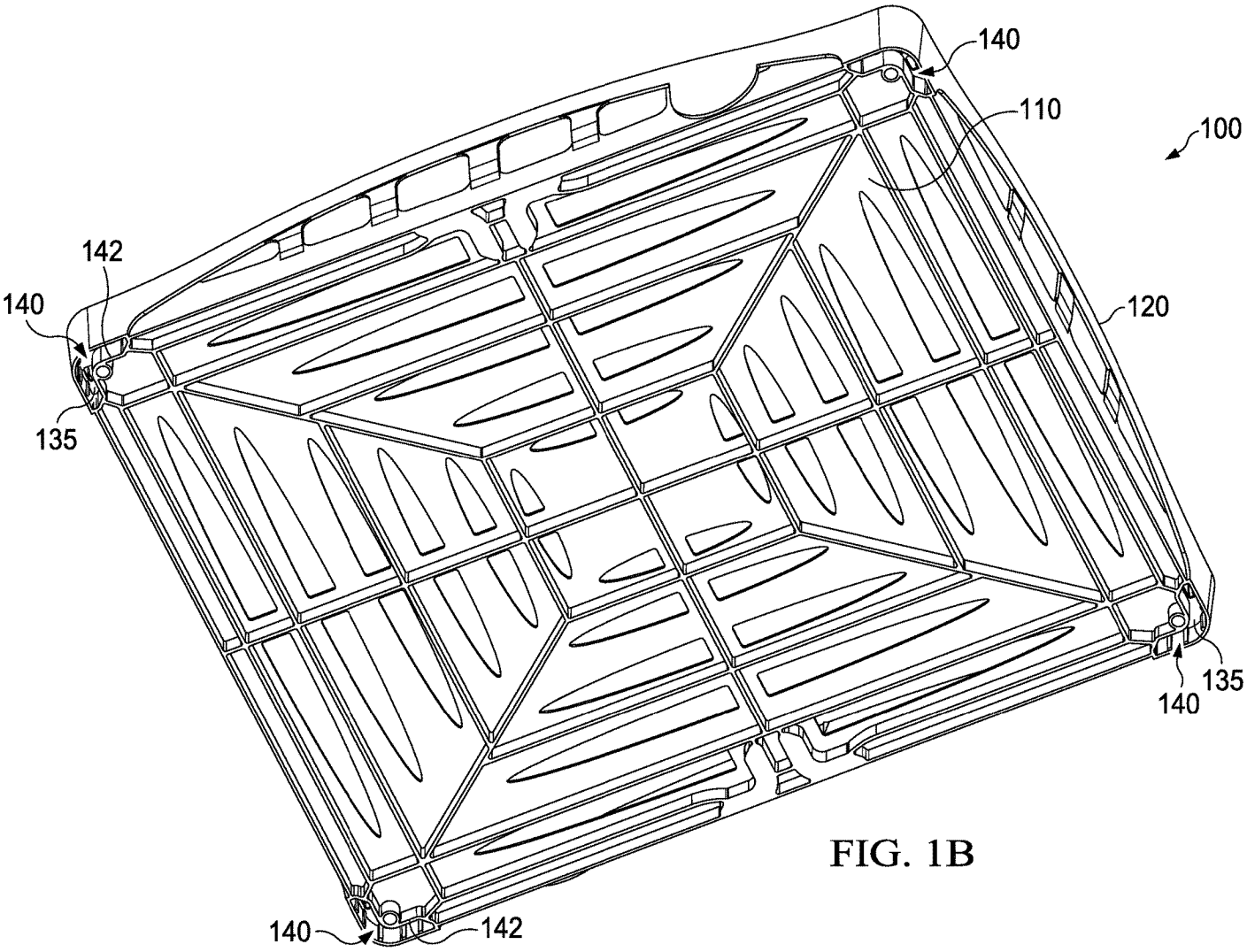
FIG. 1B is a bottom perspective view of one embodiment of a molded plastic tray of a modular food product display stand in accordance with the disclosed principles.

Referring now to FIGS. 1A and 1B, illustrated is a molded plastic tray 100 of a modular food product display stand in accordance with an embodiment of the disclosed principles. The molded plastic tray 100 is designed to hold and display food products, and is a component of the modular food display stand. The molded plastic tray may comprise of a tray body 110 and tray sides 120. In one embodiment, the tray sides 120 and the tray body 110 may be one complete unit, and in alternative embodiments, the tray sides 120 may be detached and reattached to the tray body 110 to form the tray 100. The tray 100 may have any shape, and in preferred exemplary embodiments, the molded plastic tray 100 has a rounded rectangular or a square shape. The tray 100 may be constructed from plastic, wood, or any other rigid material via any currently available or later developed method of shaping the tray 100, and is preferably constructed from polypropylene via injection moulding.

The tray body 110 forms the base structure of the tray 100, and is enclosed by the tray sides 120. The tray body 110 generally has a rectangular shape. The top of the tray body 110 may incorporate cut-outs for aesthetics and to decrease the overall mass and weight of the tray 100. The bottom of the tray body 110 may incorporate a support structure, as shown in FIG. 1B, for supporting the tray 100 when food products are placed on top of the tray 100. The support structure may be designed differently so as to increase the maximum weight that the tray 100 is able to support. The support structure on the bottom of the tray 100 may also form a part of or connect to the bottom slots 140, which is further discussed below.

The tray sides 120 may be angled outward, so that the tray sides 120 are not perpendicular to the tray body 110 of the tray 100. The degree that the tray sides 120 are angled out may range from 1 to 5 degrees from the center of the tray 100, and in a preferable embodiment, the tray sides angle four degrees away from the normal. Because the tray sides 120 may be angled outward, the tray 100 can easily stack on top of another tray of the same design, so that the tray 100 can nest inside the other tray. Furthermore, the tray sides 120 may be designed to incorporated handles for easy handling, and the handles may be cut out from or attached to the tray sides 120. In the present exemplary embodiment, the top of the tray sides 120 are arcuate to incorporate cut-out handles on all four tray sides 120.

In a preferable exemplary embodiment, the tray 100 measures approximately 58.9 cm in length and approximately 48.85 cm in width at the base of the tray 100, and these measurements may differ, to approximately 60 cm in length and approximately 50 cm in width, if the tray 100 is measured along the top of the tray sides 120 because the tray sides 120 of the tray 100 may angle outward from the center of the tray 100. Because of the arcuate nature of the tray sides 120, the height of the tray 100 may range from approximately 4.5 cm to approximately 7.7 cm.

The tray 100 has a slot at each corner (top and bottom) of the tray 100 attached to the tray sides 120, and each slot is shaped to receive an insertable post or an insertable foot, as further discussed below. FIG. 1A illustrates the top corner slots 130 on the top of the tray 100, and FIG. 1B illustrates the bottom corner slots 140 on the bottom of the tray 100. The slots 130 and 140 are preferably shaped to receive insertable posts in the exemplary embodiment, and may have different shapes in alternative embodiments. In the present exemplary embodiment, the slots 130 and 140 have an arcuate shape with flattened ends, with the outer bend of the slots 130 and 140 flush against or directly contacting the rounded corners of the tray sides 120. The arcuate shape of the slots 130 and 140 generally resembles a rounded L-shape with sides of equal length.

Each slot is formed by an inner wall (inner wall 132 for the top slots 130 and inner wall 142 for the bottom slots 140) and an outer wall formed by the rounded corners of the tray sides 120. For the bottom slots 140, the inner wall 142 may be formed by the support structure on the bottom of the tray body 110. The height of the outer wall and the inner wall 142 are the same so that the bottom slots 140 are level with the support structure on the bottom of the tray body 110 to lay flat on a surface. On the other hand, the inner wall 132 of the top slots 130 may have a smaller height as compared to the height of the outer wall formed by the tray sides 120. With the inner wall 132 of the top slots 130 having a smaller height, when a second tray of the same design is stacked on top of the tray 100, the inner wall of the top slots 130 suspends the second tray from the top of the tray body 110 while the second tray is nested in the tray 100. By suspending the second tray, the design of the tray 100 allows for items to be placed between the trays while the trays are stacked together and on top of each other.

Figure 3:
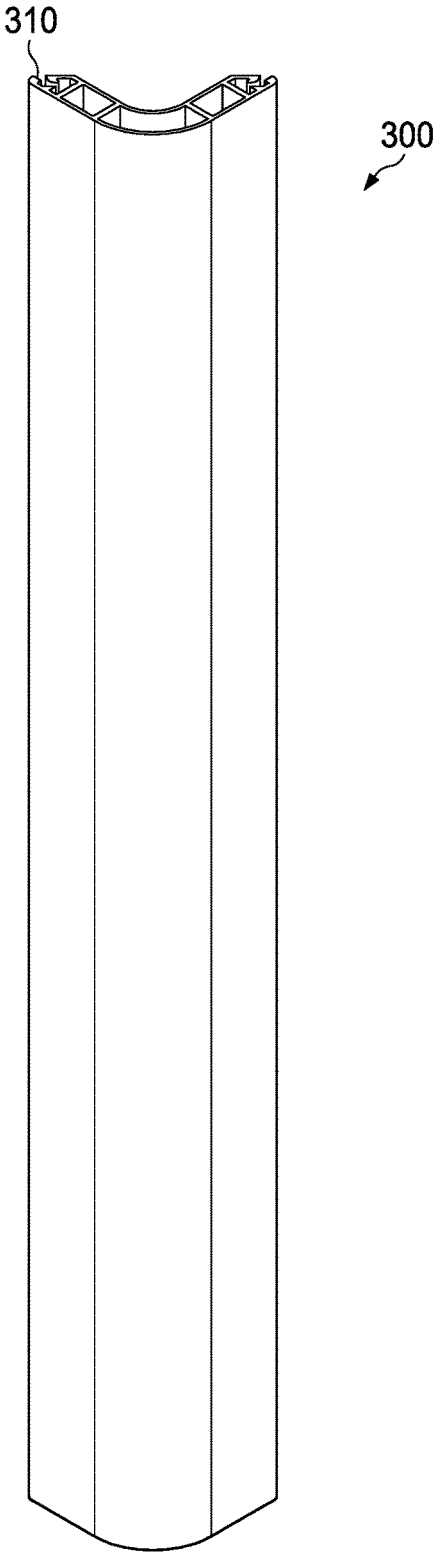
FIG. 3 is a perspective view of one embodiment of a plastic insertable post of a modular food product display stand in accordance with the disclosed principles.

The top slots 130 and bottom slots 140 are separated from each other by dividers 135. In a preferable embodiment, the dividers 135 are not level with the tray body 110, but are instead raised above the tray body 110. By raising the dividers 135 above the tray body 110, when the insertable posts 300 of FIG. 3 are inserted into the slots 130 and 140, the posts 300 may be able to securely fit into both the top slots 130 and bottom slots 140. Because the dividers 135 separate the top slots 130 and the bottom slots 140, the height of the inner wall 142 differs from the height of the top slots 130 themselves. The height of the inner wall 132 of the top slots 130 is approximately 1.7 cm while the height of the top slots 130 is approximately 1.45 cm. Accordingly, the height of the inner wall 142 of the bottom slots 140 is approximately 1.25 cm, and the height of the bottom slots 140 is approximately 2 cm. The dividers 135 also act to separate the posts 300 when inserted into the top slots 130 and the bottom slots 140, and may incorporate holes to decrease the overall weight of the tray 100.

The top slots 130 and bottom slots 140 may have a series of spacers along the interior of the top slots and bottom slots 140 to prevent the insertable posts 300 from directly contacting the tray sides 120 or the inner walls 132 and 142 of the slots 130 and 140 respectively. The spacers protrude out from the tray sides 120 and the inner walls 132 and 142 into the slots 130 and 140 respectively, and they run normal to the tray body 110 of the tray 100. The spacers also assist with securing the insertable posts 300 to the tray 100 when the posts 300 are inserted into the slots 130 and 140.

The tray 100 may also have middle slots 150, as shown in the present exemplary embodiment of FIGS. 1A and 1B. The middle slots 150 are designed to receive insertable posts to form a pyramid food product display stand further discussed below with reference to FIG. 10. The middle slots 150 may be formed into the same shape as the top slots 130 and the bottom slots 140, and may have an arcuate shape with flattened ends that generally resembles a rounded L-shape with sides of equal length. The middle slots 150 may be oriented so that for each pair of middle slots 150 located along the tray sides 120, one side of each middle slot 150 is parallel to the tray sides 120 and this side of each middle slot 150 may be flush or directly contacting the tray sides 120. The other side of each middle slot 150 is back to back with the other side of the other middle slot 150 of the pair, so that each half of the tray 100 is a mirror image of the other half of the tray 100.

Like the slots 130 and 140, each middle slot 150 is formed by an inner wall 152 and an outer wall formed by the tray sides 120. However, unlike the slots 130 and 140, the middle slots 150 have a bottom that is level with the support structure so that the support structure and the middle slots 150 lie flat on a surface with the rest of the tray 100. The support structure of the tray body 110 may form parts of or may connect to the middle slots 150.

In a preferable embodiment, the middle slots 150 have a depth of approximately 1.8 cm. The middle slots 150 may have raised lips that may increase the depth of the middle slots 150, and these raised lips may help with securing the posts 300 to the tray 100.

Figure 2:
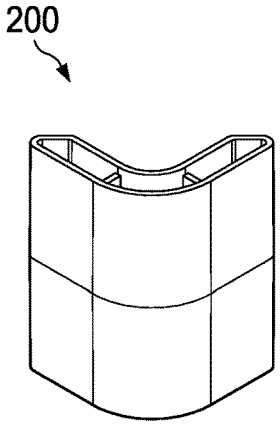
FIG. 2 is a perspective view of one embodiment of a plastic foot of a modular food product display stand in accordance with the disclosed principles.

Referring now to FIG. 2, illustrated is a plastic insertable foot 200 of the modular food product display stand in accordance with an embodiment of the disclosed principles. The insertable foot 200 is shaped to be inserted into the bottom slots 140 of the tray 100, and support the tray 100 and the rest of the modular food product display stand from sitting on the ground. Four insertable feet 200 may be inserted into the bottom slots 140 of the tray 100 to suspend the tray 100 and rest of the modular food product display stand from the ground. The insertable foot 200 may be used with any embodiment of the plastic tray of FIGS. 1A and 1B.

In the present exemplary embodiment, the foot 200 has an arcuate shape with flattened ends and generally resembles a rounded L-shape with sides of equal lengths. In other embodiments, the foot 200 may have different shapes corresponding to the shape of the bottom slots 140 of the tray 100. The foot 200 may also incorporate an internal support structure in order to maintain the shape of the foot 200. The foot 200 may be constructed from plastic, wood, or any other rigid material via any currently available or later developed method of constructing the foot 200, and is preferably constructed from polypropylene via injection moulding. Alternatively, the foot 200 may be made via an extrusion process.

In a preferable embodiment of the insertable foot 200, the foot 200 measures approximately 3.9 cm in length approximately 0.9 cm in width, and approximately 6 cm in height.

Referring now to FIG. 3, illustrated is a plastic insertable post 300 of the modular food product display stand in accordance with an embodiment of the disclosed principles. The insertable post 300, like the insertable foot 200 of FIG. 2, is shaped to be inserted into the top slots 130 and into the bottom slots 140 of the tray 100, and to support one tray from another tray. Four insertable posts 300 may be inserted into the top slots 130 of a first tray and into the bottom slots 140 of a second tray in order to suspend the first tray from the second tray.

In the present exemplary embodiment, the post 300 has an arcuate shape with openings 310 at the tips of the post 300, and generally resembles a rounded L-shape with sides of equal length. In other embodiments, the post 300 may have different shapes corresponding with the shape of the top slots 130 and the bottom slots 140 of the tray 100. The post 300 may also incorporate an internal support structure in order to maintain the shape of the post 300 and to stabilize the modular food product display stand's overall structure. The internal support structure increases the displays stand's resistance to loading and shock when food products are loaded onto the display stand or when a customer bumps into the display stand on accident. Because of the modularity of the present invention, the post 300 may have the same general shape as the insertable foot 200 of FIG. 2, and the top slots 130 and the bottom slots 140 of the tray 100 of FIGS. 1A and 1B are able to receive both the insertable foot 200 and the insertable post 300.

The post 300 may be constructed from plastic, wood, or any other rigid material any currently available or later developed method of constructing the post 300, and is preferably constructed from polypropylene via injection moulding. Alternatively, the post 300 may be made via an extrusion process so the plastic posts may have different lengths, and therefore increases the flexibility and adaptability of the food product display stand. The post 300 may be constructed from a transparent polypropylene, so that when multiple posts 300 are installed into the modular food product display stand, the transparency of the posts 300 allows consumers to see the entire food product as displayed.

The openings 310 of the post 300 are gaps that run from the top of the post 300 to the bottom of the post 300. The openings 310 may also incorporate hook-like protrusions as a part of the internal support structure of the post 300, and these hook like protrusions along the openings 310 may facilitate any aesthetic or decorative additions to be attached to the modular food product display stand.

In a preferable embodiment, the post 300 measures approximately 3.9 cm in length, approximately 0.9 cm in width, and approximately 38 cm in height.

Referring now to FIG. 4, illustrated is a molded plastic topper 400 of a modular food product display stand in accordance with an embodiment of the disclosed principles. The molded plastic topper is designed to secure insertable posts, and may act as an intermediary component for combining multiple modular food product display stands, as further discussed with reference to FIG. 11. The molded plastic topper 400 may comprise a topper body 410 and topper sides 420. In one embodiment, the topper sides 420 and the topper body 410 may be one complete unit, and in alternative embodiments, the topper sides 420 may be detached and reattached to the topper body 410 to form the topper 400. The topper 400 may have any shape, and in preferred exemplary embodiments, the topper 400 has a rectangular or square shape. The topper 400 may be constructed from plastic, wood, or any other rigid material via any currently available or later developed method of constructing the topper 400, and is preferably constructed from polypropylene via injection moulding.

Figure 4A:
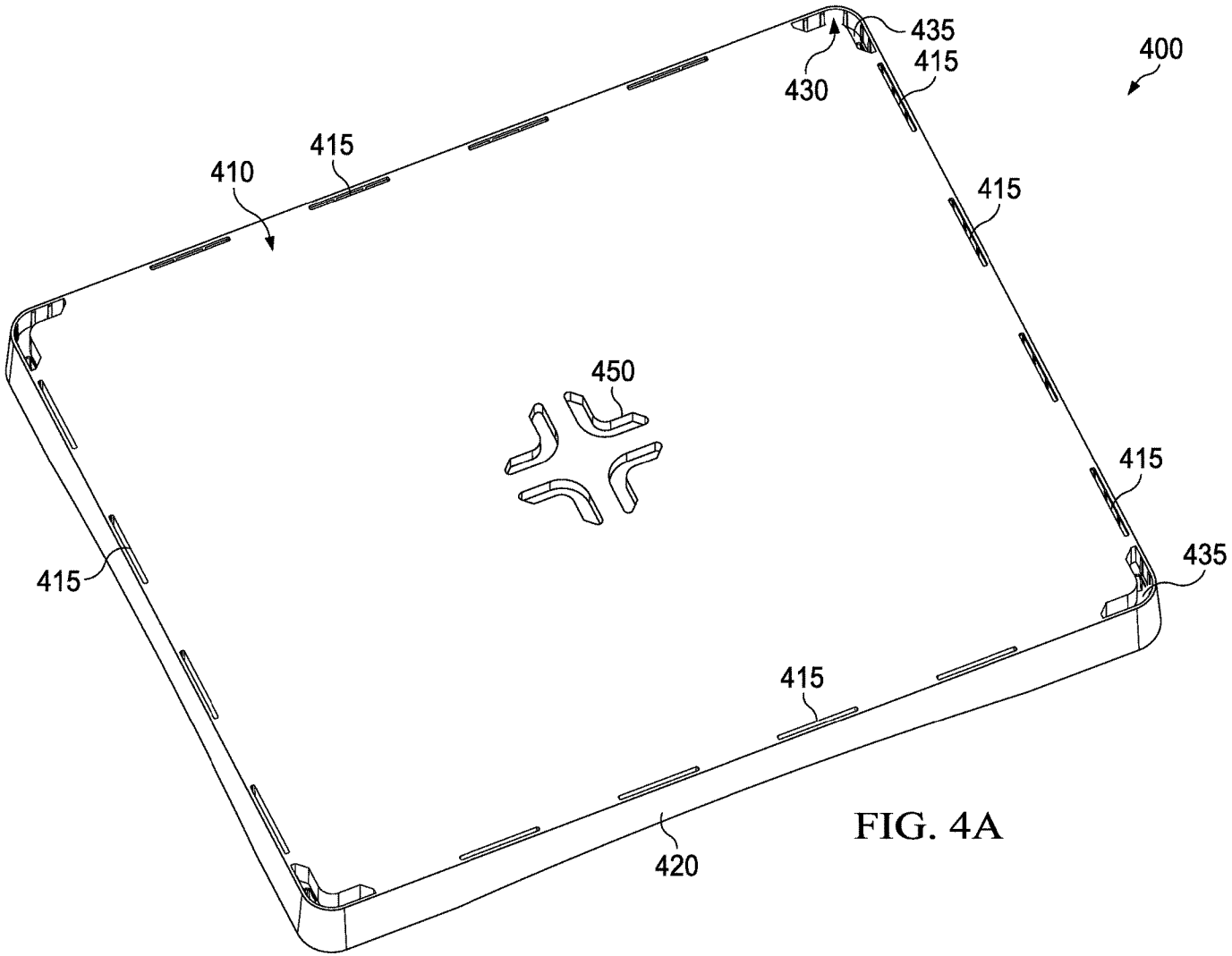
FIG. 4A is a top perspective view of one embodiment of a molded plastic topper of a modular food product display stand in accordance with the disclosed principles.
Figure 4B:
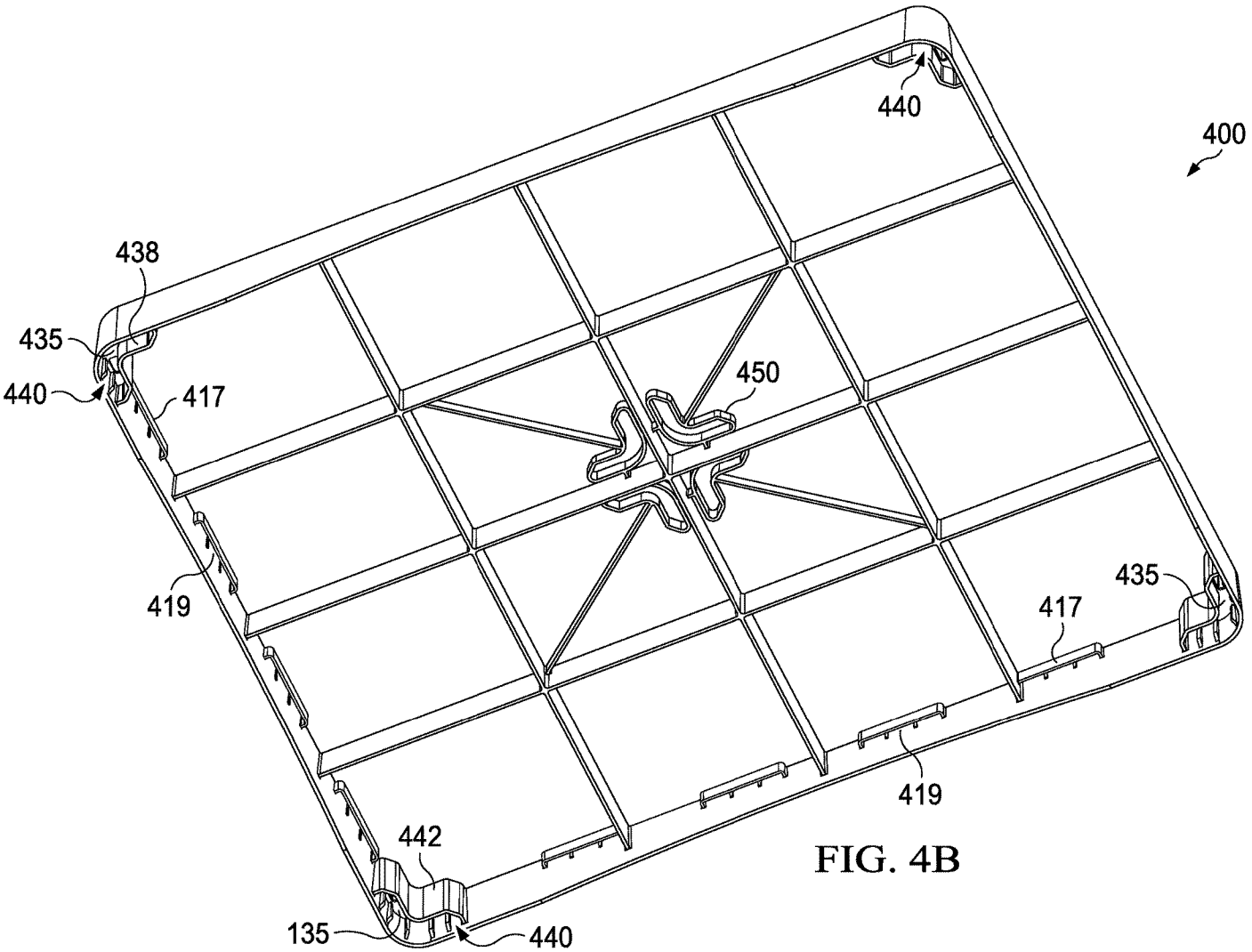
FIG. 4B is a bottom perspective view of one embodiment of a molded plastic topper of a modular food product display stand in accordance with the disclosed principles.

The topper body 410 forms the top surface of the modular food product display stand and the base structure of the topper 400, and is enclosed by the topper sides 420. The topper body 410 generally has a rounded rectangular shape. The bottom of the topper body 410 may incorporate a support structure, as shown in FIG. 4B, for supporting the topper. The support structure may have a design different from that shown in FIG. 4B so as to increase the maximum weight that the topper 400 can support.

The topper body 410 may have slits 415 along the border of the topper body 410 for joining multiple modular food product display stands, as further discussed below, via the stand clip 500 shown in FIG. 5. The topper body 410 may have any number of slits 415 in any number of different arrangements and different slit lengths and widths, so long as one of the clip legs 520 of the stand clip 500 is able to fit into the slits 415. In a preferable embodiment, the slits 415 measure approximately 5.5 cm in length and approximately 0.36 cm in width.

Each slit 415 may have a tab 417 projecting downward from the topper body 410 and connected to the topper sides 420 as shown in FIG. 4B. Each slit 415 may also have a spacer 419 projecting inward from the topper sides 420 as shown in FIG. 4B. The tabs 417 work in conjunction with the spacers 419 to prevent the stand clips 500 from sliding up and down the slits 415, which is further described and discussed below.

The topper sides 420 may be designed to curve along the bottom edge, and to angle outward so that the topper sides 420 are not perpendicular to the plane formed by the topper body 410. The topper sides 420 may be angled from 1 to 5 degrees from the center of the topper 400, and in a preferable embodiment, the topper sides 420 angle four degrees out from the normal. Because the topper sides 420 may be angled outward, the topper 400 may be flipped upside down and easily stacked on top of the tray 100, so that the topper 400 can nest inside the tray 100.

In a preferable exemplary embodiment, the topper 400 measures approximately 59.45 cm in length and approximately 49.45 cm in width, and these measurements may differ if the topper 400 is measured along the bottom of the topper sides 420, where the topper sides 420 connect to the topper body 410, because the topper sides 420 may angle outward from the center of the topper 400. Further, because the curved nature of the topper sides 420, the height of the topper 400 may range from approximately 39.5 cm to approximately 45 cm.

The topper 400 has a slot at each corner (top and bottom) of the topper 400 attached to the topper sides 420, and each slot is shaped to receive an insertable post or an insertable foot, as discussed above. FIG. 4A illustrates the top corner slots 430 on the top of the topper 400, and FIG. 4B illustrates the bottom corner slots 440 on the bottom of the topper 400. The topper slots 430 and 440 are preferable shaped to receive the insertable posts in the present exemplary embodiments, and may have different shapes in alternative embodiments. In the present exemplary embodiment, the topper slots 430 and 440 are formed into an arcuate shape with flattened ends, with the outer bend of the topper slots 430 and 440 flush against the rounded corner of the topper sides 420. The shape of the topper slots 430 and 440 generally resemble a rounded L-shape with sides of equal length.

Each topper slot is formed by an outer wall formed by the corners of the topper sides 420 and an inner wall 442 attached to the topper sides 420. For the top topper slots 430, the top of these slots 430 are level with the top surface of the topper body 410. For the bottom topper slots 440, the inner wall 442 may have a smaller height as compared to the height of the outer wall formed by the topper sides 420. The height difference between the inner wall 442 and the outer wall formed by the topper sides 420 helps to hide the topper slots 430 and 440.

The top topper slots 430 and the bottom topper slots 440 are separated from each other by dividers 435. In a preferable embodiment, the dividers 435 are not level with the topper body 410 but are instead set below the surface of the topper body 410. By lowering the dividers 435 below the surface of the topper body 410, when the posts are inserted into the topper slots 430 and 440, the posts may be able to securely fit into both the top topper slots 430 and the bottom topper slots 440. Because the dividers 435 separate the top topper slots 430 and the bottom topper slots 440, the height of the inner wall differs from the sum of the heights of the top topper slots 430 and the bottom topper slots 440. The height of the inner wall 442 is approximately 3.9 cm, while the heights of the topper slots 430 and 440 are approximately 1.85 cm.

The topper 400 may have four center slots 450 near the center of the topper 400, and each center slot 450 is shaped to receive an insertable post or an insertable foot. FIG. 4A illustrates the center slots 450 from a top perspective view of the topper 400, and FIG. 4B illustrates the center slots 450 from a bottom perspective view of the topper 400. The center slots 450 are preferably shaped to receive insertable feet in the exemplary embodiment, and may have different shapes in alternative embodiments. In the present exemplary embodiment, the center slots 450 are formed into an actuate shape with flattened ends, with the outer bend of the center slots 450 pointing toward the center of the topper 400, and generally resembles a rounded L-shape with sides of equal length. The center slots 450 may be arranged so that each half of the topper 400 is a mirror image of the other half of the topper 400.

Figure 5:
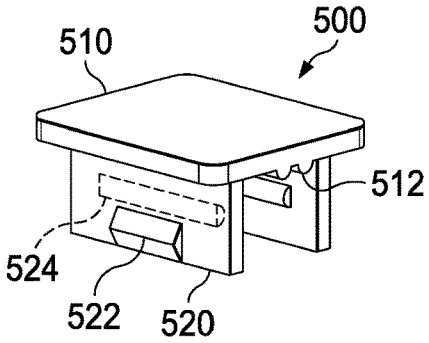
FIG. 5 is a perspective view of one embodiment of a plastic insertable clip of a modular food product display stand in accordance with the disclosed principles.

Referring now to FIG. 5, illustrated is a plastic insertable stand clip 500 of the modular food product display stand in accordance with an embodiment of the disclosed principles. The insertable stand clip 500 is shaped to be inserted into the slits 415 of the topper 400 to join multiple modular food product display stands together. The stand clip 500 may comprise a clip top 510 and clip legs 520. The stand clip 500 may be constructed from plastic, wood, or any rigid material via any currently available or later developed method of constructing the stand clip 500, and is preferable constructed from polypropylene via injection moulding.

The clip top 510 connects the two clip legs 520 so that the stand clip 500 can secure two modular food product display stand together. The clip top 510 may comprise two rounded ridges 512 that are spaced apart from each other and are located on the underside of the clip top 510. The ridges 512 are designed to stabilize and hold the topper 400 when the stand clip 500 is attached to the topper 400. Because of the positioning of the slits 415 of the topper 400 next to the topper sides 420, when attaching the stand clip 500 to the topper 400, the topper sides 420 slides between the two clip legs 520 and between one clip leg 520 and one of the two ridges 512. The ridges 512 may span the entire length or a portion of the clip top 510.

The clip legs 520 are connected to the clip top 510 and may be spaced a part from each other. The clip legs 520 may have a set of angled protrusions 522 on the outward facing sides of the clip legs 520, and a set of rounded protrusions 524 on the inward facing sides of the clip legs 520. Both the angled protrusions 522 and the rounded protrusions 524 may span the length of the stand clip 500, or as shown in FIG. 5, may have a length smaller than the length of the stand clip 500.

When the stand clip 500 is inserted into a slit of a first topper and into a slit of a second topper, the angled protrusions 522 on the outward facing sides of the legs 520 of the stand clip 500 catch onto the tab 417 corresponding to each slit 415. The rounded protrusions 524 may press against the spacers 419 on the inside of the slits and may force the clip leg 520 outward so that the stand clip 500 remains caught on the tab 417 of each slit 415.

In a preferable exemplary embodiment, the stand clip 500 measures approximately 3.6 cm in length, approximately 3.5 cm in width, and approximately 2.2 cm in height. These measurements may differ because of the arcuate nature of the sides of the clip top 510. The stand clip 500 may have different measurements in other embodiments in order to accommodate the size of the slits 415 of the topper 400.

Figure 6A:
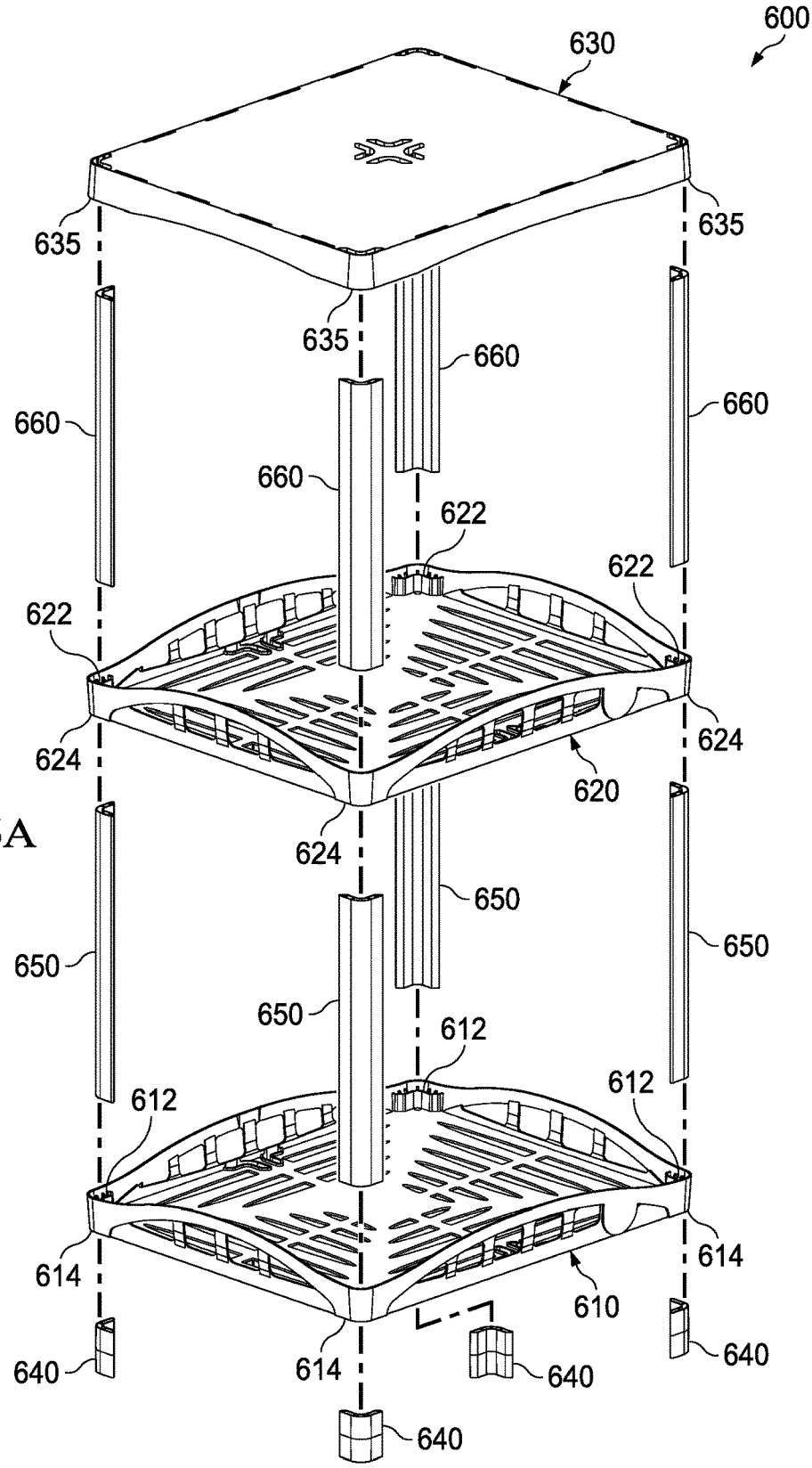
FIG. 6A is an exploded view of one embodiment of the modular food product display stand in accordance with the disclosed principles.
Figure 6B:
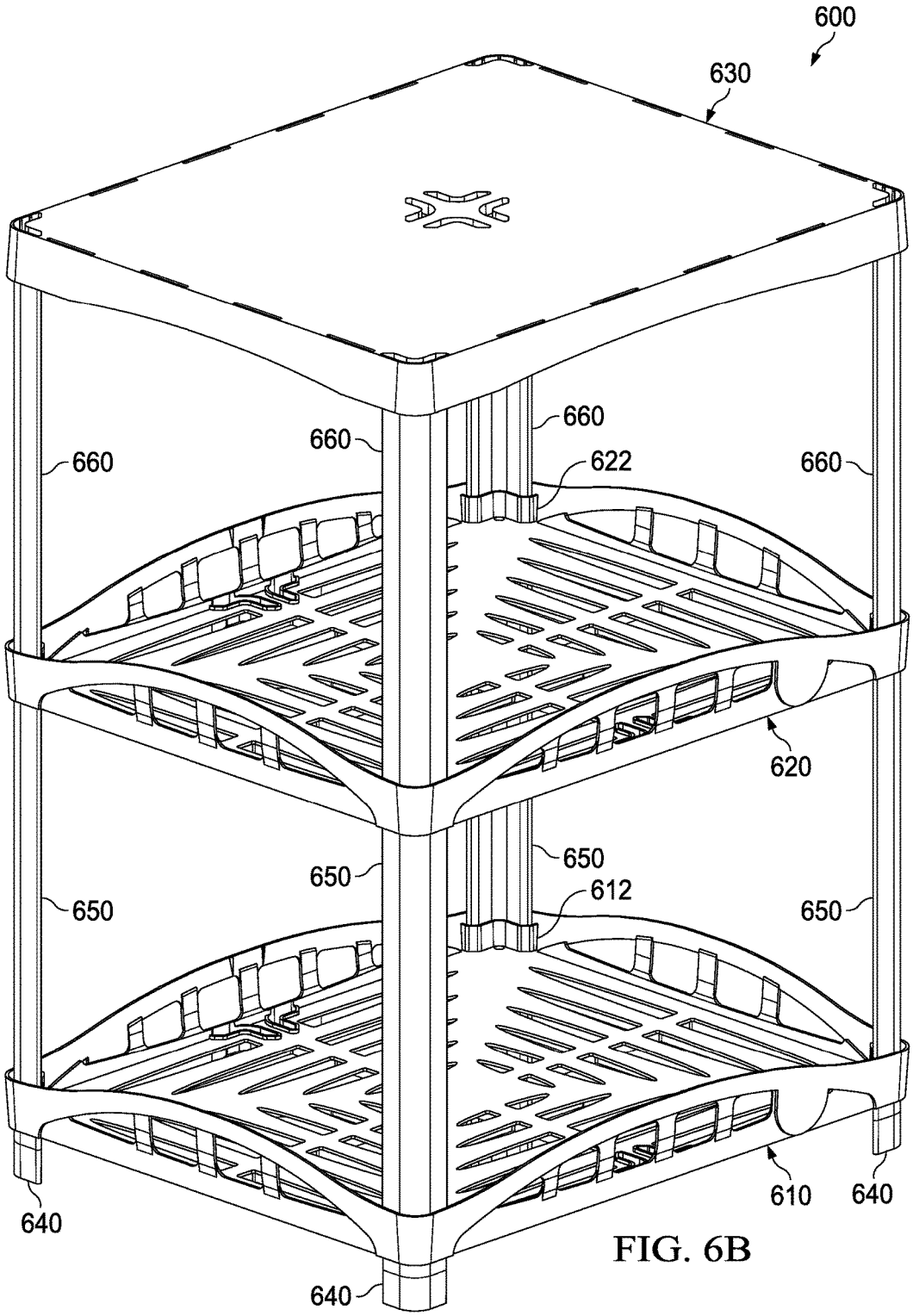
FIG. 6B is a perspective view of one embodiment of the modular food product display stand assembled in accordance with the disclosed principles.

FIG. 6A is an exploded view of a modular food product display stand 600 in accordance with an embodiment of the disclosed principles, and demonstrates how the components of the modular food product display stand may be connected to each other. FIG. 6B illustrates an assembled modular food product display stand 600 in accordance with an embodiment of the disclosed principles. FIGS. 6A and 6B illustrate an exemplary embodiment of the modular food product display stand 600 with only two layers. The topper in the present exemplary embodiment is not considered a layer, but in alternative embodiments, the topper may be used to hold food products like the trays of the modular food product display stand 600 and may therefore be considered a layer. The modular food product display stand 600 may be constructed to incorporate any number of layers, and in order to incorporate additional layers to the modular food product display 600, each additional layer requires a tray and four insertable posts In the present exemplary embodiment, the modular food product display stand 600 comprises a first tray 610, a second tray 620, a topper 630, four insertable feet 640, a first set of insertable posts 650, and a second set of insertable posts 660. Starting from the bottom, the insertable feet 640 are inserted into the bottom slots 614 of the first tray 610, and then the first set of insertable posts 650 are inserted into the top slots 612 of the first tray 610. Once the first set of insertable posts 650 are secured in the top slots 612 of the first tray 610, the bottom slots 624 of the second tray 620 are aligned with the first set of insertable posts 650, and then the first set of insertable posts 650 are inserted into the bottom slots 624 of the second tray 620. Similarly, the second set of insertable posts 660 are inserted into the top slots 622 of the second tray 620 before being aligned with and inserted into the bottom slots 635 of the topper 630. The result of constructing the components as discussed is the modular food product display stand 630 with two layers as shown in FIG. 6B.

As mentioned previously, the modular food product display stand 600 may be expanded to incorporate any number of layers. In order to expand the present exemplary embodiment modular food product display 600, each additional layer requires a tray and four insertable posts.

Figure 7A:
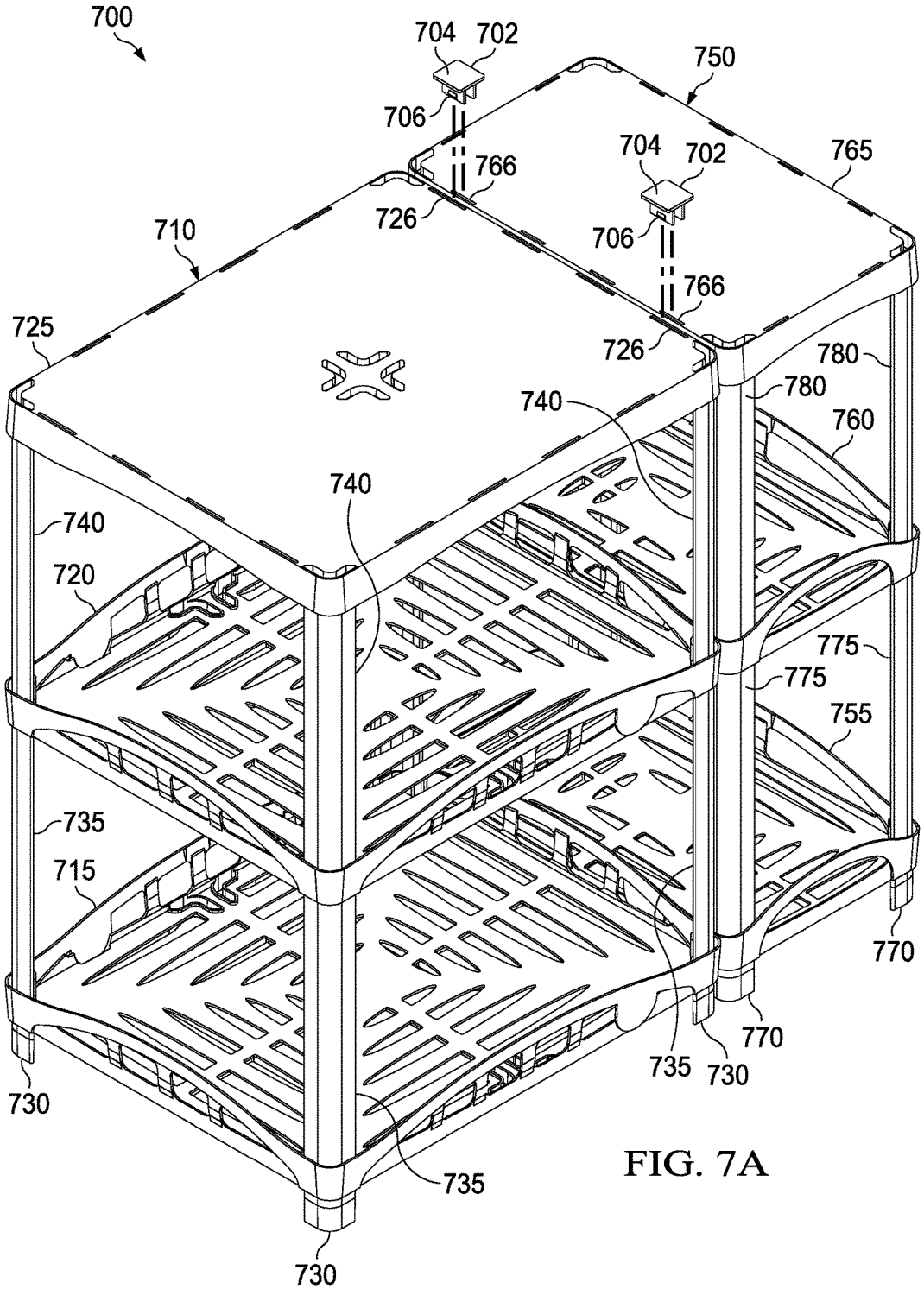
FIG. 7A is an exploded view of two different embodiments of the modular food product display stand to be secured together.
Figure 7B:
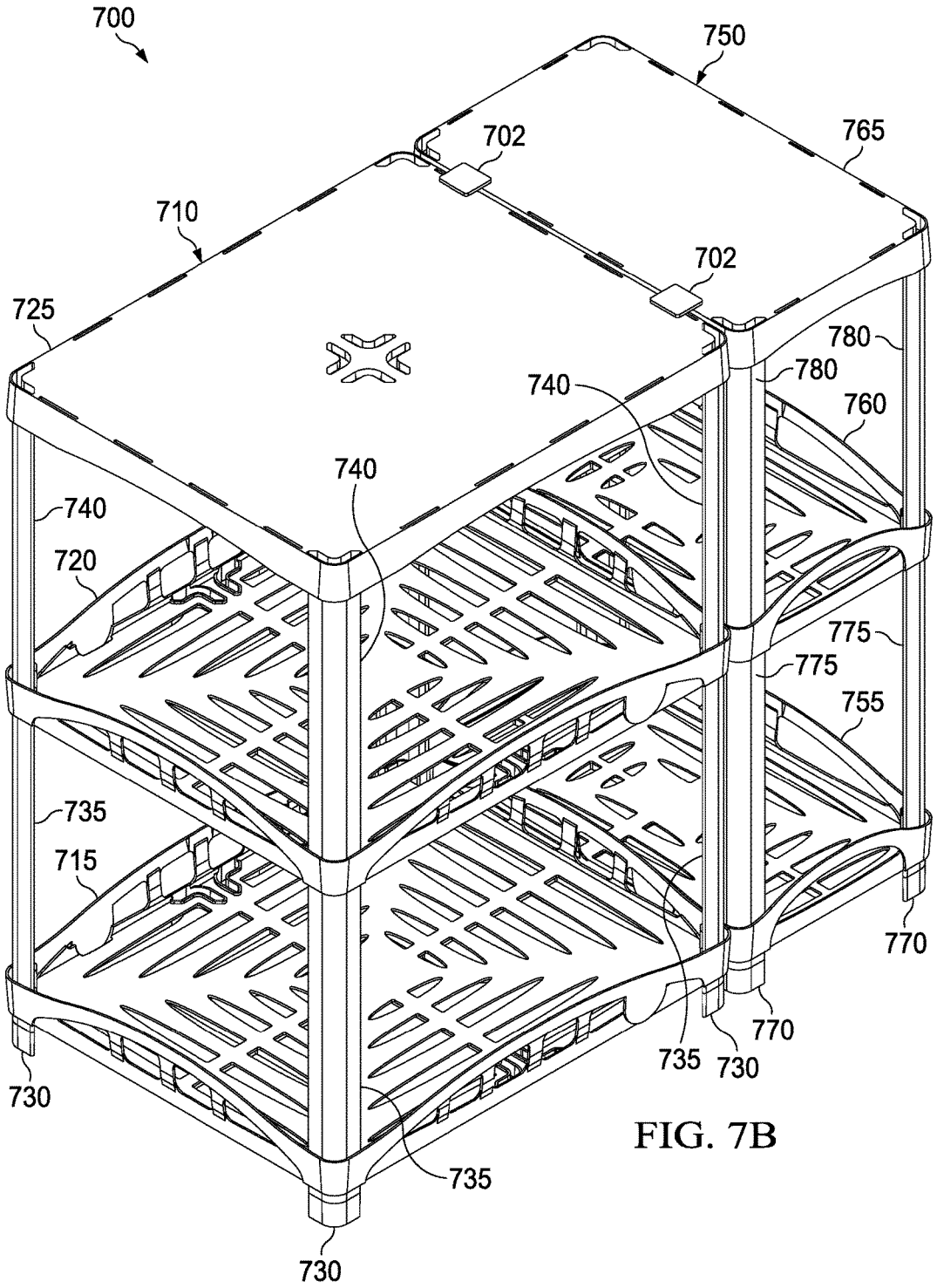
FIG. 7B is a perspective view of two different embodiments of the modular food product display stand secured together.
Figure 7C:
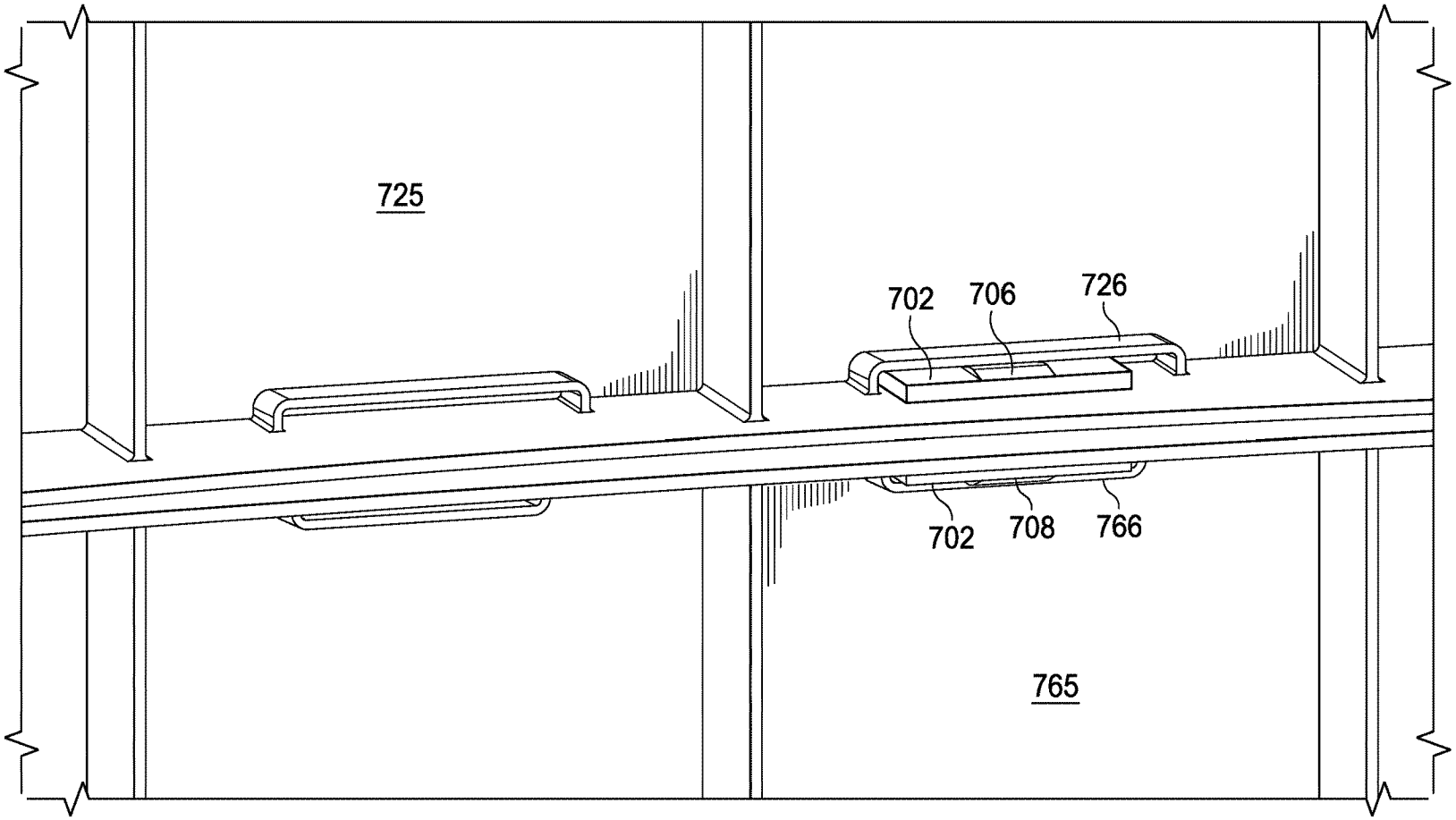
FIG. 7C is a bottom perspective view of two different embodiments of the modular food product display stand secured together with stand clips.

FIG. 7A is an exploded view of two different embodiments of the modular food product display stand in accordance with the disclosed principles, and demonstrates how the stand clip 500 of FIG. 5 may be connected with two modular food product display stands in order secure the display stands together. FIG. 7B illustrates an assembled view of the two different embodiments of the modular food product display stand in accordance with the disclosed principles. FIG. 7C illustrates a bottom perspective view of the two different embodiments of the modular food product display stand secured together with stand clips in accordance with the disclosed principles.

FIGS. 7A and 7B illustrate two exemplary embodiments of the modular food product display stand with only two layers, and FIG. 7C illustrates how the stand clip 702 connects the two exemplary embodiments of the modular food product display stand together. The first modular food product display stand 710 comprises components of the first embodiment of the modular food product display stand, as shown in FIGS. 1-6, and may comprise a first tray 715, a second tray 720, a topper 725, four insertable feet 730 (one of which is not shown in FIGS. 7A and 7B), a first set of insertable posts 735 (each set comprises four insertable posts, one of which is not shown in FIGS. 7A and 7B), and a second set of insertable posts 740 (one of which is not shown in FIGS. 7A and 7B). The second modular food product display stand 750 is a second embodiment of the modular food product display stand, as further disclosed with reference to FIG. 8. The second modular food product display stand 750 also comprises a first tray 755, a second tray 760, a topper 765, four insertable feet 770 (two of which are not shown in FIGS. 7A and 7B), a first set of insertable posts 775 (each set comprising four insertable posts, and two of which are not shown in FIGS. 7A and 7B), and a second set of insertable posts 780 (two of which are not shown in FIGS. 7A and 7B). Each modular food product display stand is constructed in accordance with the disclosed principles.

The first modular food product display stand 710 and the second modular food product display stand 750 may be lined up or positioned next to each other in order secure the two modular food product display stands together. As shown in FIGS. 7A and 7B, the width of the first modular food product display stand 710 may be approximately the same as the length of the second modular food product 750. Although the slits 726 of the first topper 725 and the slits 766 of the second topper 765 may have different lengths, the slits 726 and 766 may be lined up together so that the clip legs 706 of the stand clips 702 can fit into the slits 726 and 766.

The stand clips 702 may be lined up with any combination of the slits 726 and 766. In a preferable embodiment, the stand clips 702 are positioned above the outer slits or the set of slits positioned furthest away from each other. With alternative embodiments, the stand clips 702 may be lined up with a different combination of slits 726 and 766 depending on the possible alignments of toppers of the modular food product display stands 710 and 750. Furthermore, FIGS. 7A and 7B illustrate the installation of two stand clips 702; however, any number of stand clips may be used to secure the two modular food product display stands together. In a preferable embodiment, at least two stand clips are required in order to secure the two modular food product display stands together.

Once the stand clips 702 are lined up, the stand clips 702 are inserted and pressed into the slits 726 and 766. FIG. 7C shows that as the stand clips 702 are pressed into the slits 726 and 766, the angled protrusions 706 of the stand clips 702 are forced past the tabs 727 and 767 of the slits 726 and 766 and forced out via pressure from contact between the rounded protrusions of the stand clips 702 (as shown in FIG. 5) and the spacers 419 of the toppers (as shown in FIG. 4B). The angled protrusions 706 of the stand clips 702 catch onto the edge of the tabs 727 and 767 of the slits 726 and 766 (shown in FIG. 4B). The pressure from the contact between the rounded protrusions of the stand clips 702 and the spacers of the toppers 725 and 765 keeps the angled protrusions 706 of the stand clips 702 caught on the edges of the tabs 727 and 767 of the slits 726 and 766 and thereby prevents the stand clips 702 from sliding up and down or from moving. With the stand clips 702 firmly caught on the tabs 727 and 767 of the slits 726 and 766, the stand clips 702 secure the first modular food product display stand 710 to the second modular food product display stand 750, as shown in FIGS. 7B and 7C.

Figure 8:
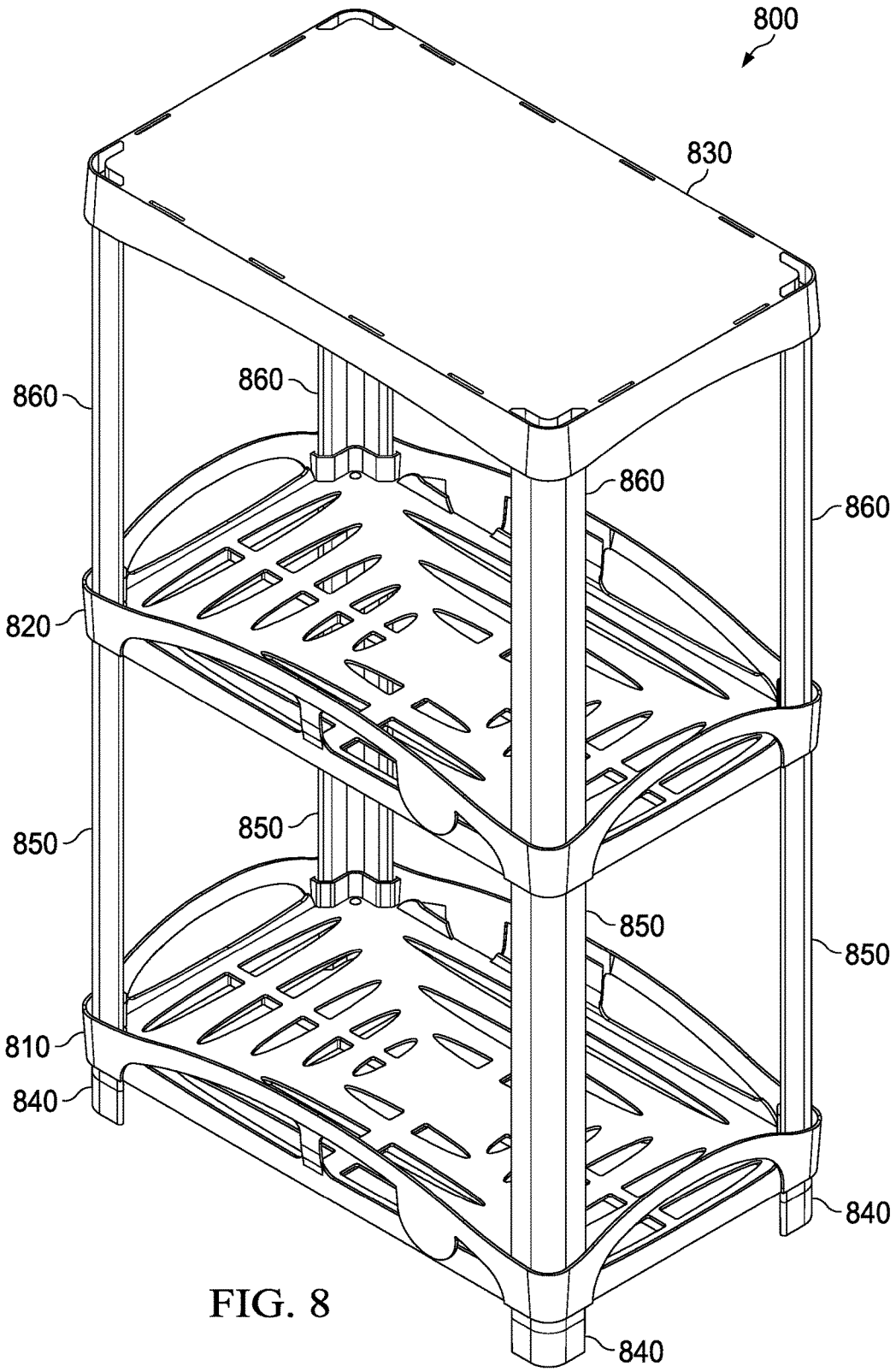
FIG. 8 is a perspective view of a second embodiment of the modular food product display stand assembled in accordance with the disclosed principles.

Referring now to FIG. 8, illustrated is a perspective view of a second embodiment of the modular product display stand. This second exemplary embodiment of the modular product display stand 800, like the first exemplary embodiment, comprises trays 810 and 820, a topper 830, insertable feet 840, and insertable posts 850 and 860; however, the sizes of the trays 810 and 820 and the topper 830 are different from the first exemplary embodiment of the modular food product display stand. This second exemplary embodiment of the modular food product display stand is constructed according to the disclosed principles.

The trays 810 and 820 of the second exemplary embodiment of the modular food product display stand 800 measures approximately 48.7 cm in length and approximately 28.7 cm in width at the base of the trays 810 and 820, and these measurements may differ, to approximately 50 cm in length and approximately 30 cm in width, if the trays 810 and 820 are measured along the top of the tray sides because the tray sides of the trays 810 and 820 may angle outward from the center of the trays 810 and 820. The degree that the tray sides may angle outward may range from 1 to 5 degrees, and in the present exemplary embodiment, the tray sides angle four degrees from the normal. The outward angling of the tray sides allows the trays 810 and 820 to nest within each other or within another tray. Because of the arcuate nature of the tray sides, the height of the trays 810 and 820 may range from approximately 4.45 cm to approximately 7.7 cm.

Like the trays of the first exemplary embodiment as shown in FIG. 6B, the trays 810 and 820 have slots at each corner of the trays 810 and 820, and the slots are shaped to receive insertable posts 840 and 850 or an insertable foot 830, as previously discussed. However, unlike the trays of the first exemplary embodiment, the trays 810 and 820 do not have middle slots.

The topper 830 of this second exemplary embodiment of the modular food product display stand 800 measures approximately 49.1 cm in length and 29.1 cm in width, and these measurements may differ, to approximately 49.5 cm in length and 29.5 cm in width, if the topper 830 is measured along the bottom of the topper sides because the topper sides may angle outward from the center of the topper 830. The degree that the topper sides may angle outward may range from one to five degrees, and in the present exemplary embodiment, the topper sides angle four degrees from the normal. The outward angling of the topper sides allows the topper 830 to nest within trays 810 and 820 when unassembled, or another tray of similar design. Because of the curved nature of the topper sides, the height of the topper 830 may range from approximately 3.5 cm to approximately 4.5 cm.

Like the topper of the first exemplary embodiment as shown in FIG. 6B, the topper 830 has slots at each corner of the topper 830, and the slots are shaped to receive an insertable post, as previously discussed. The topper 830 also has slits along the border of the topper 830 for securing the modular food product display stand 800 to another modular food product display stand. However, unlike the topper of the first exemplar embodiment, the topper 830 does not have center slots, and the slits of the topper 830 have a smaller length and are smaller in number as compared to the slits of the topper of the first exemplary embodiment.

Despite the differences in the trays and toppers of the first exemplary embodiment and the second exemplary embodiment of the modular food product display stand, the components of the second exemplary embodiment of the modular food product display stand 800 are designed to be installed together to form the modular food product display stand 800 as shown in FIG. 8.

Figure 9:
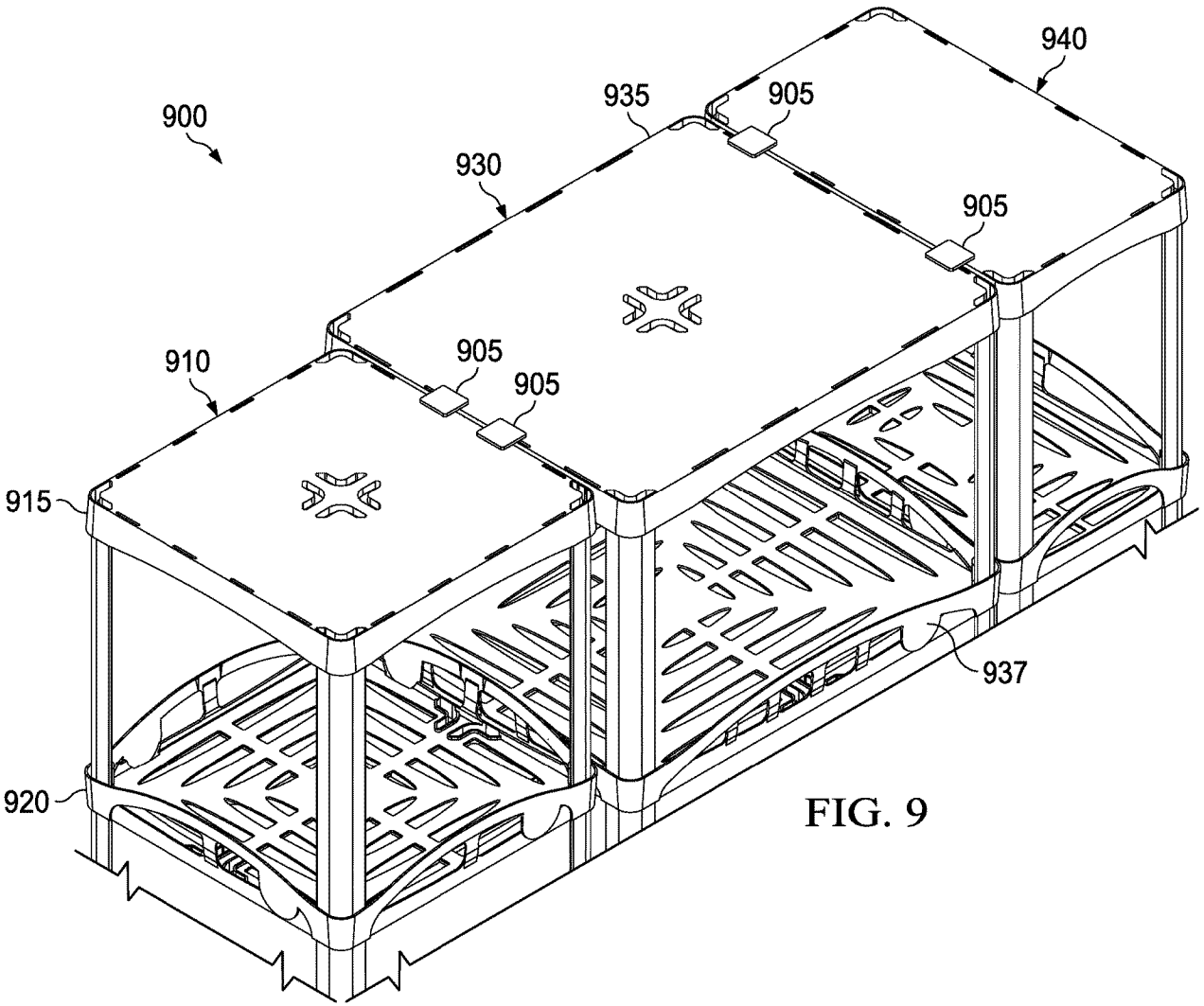
FIG. 9 is a perspective view of three different embodiments of the modular food product display stand secured together in accordance with the disclosed principles.

Referring now to FIG. 9, illustrated is a perspective view of three different embodiments of the modular food product display stand secured together in accordance with the disclosed principles. FIG. 9 includes a break line that indicates that the three different embodiments of the modular food product display stand may extend further down and may have any number of layers. As illustrated, FIG. 9 illustrates three different embodiments of the modular food product display stand: a large rectangular display stand 930, which represents the first exemplary embodiment of the present disclosure illustrated in FIGS. 1-6; a small rectangular display stand 940, which represents the second exemplary embodiment of the present disclosure illustrated in FIG. 8 and also shown in FIGS. 7A and 7B; and a square display stand 910, which is the third exemplary embodiment of the present disclosure.

The square display stand 910 is the third exemplary embodiment of the modular food product display stand. The square display stand 910 comprises a topper 915, at least one tray 920, multiple sets of insertable posts, and insertable feet, and may be constructed in the same manner as the large rectangular display stand 930 and the small rectangular display stand 940. Like the second embodiment of the modular food product display stand, the tray 920 and topper 915 of the third exemplary embodiment have different measurements.

In the third exemplary embodiment of the modular food product display stand, the tray 920 measures approximately 40.5 cm in length and width, and these measurements may differ, to approximately 42 cm in length and width, if the tray 920 is measured along the top of the tray sides because the tray sides of the tray 920 may angle outward from the center of the tray 920. The degree that the tray sides may angle outward from the center of the tray 920 may range from 1 degree to 5 degrees, and with the present exemplary embodiment, the tray sides angle four degrees out from the normal. Because of the degree that the tray sides angle out, the tray 920 may be able to nest inside another tray of the same design. Because of the arcuate nature of the tray sides, the height of the tray 920 may range from 4.45 cm to 7.7 cm.

Like the trays of the first exemplary embodiment as shown in FIG. 6B, the tray 920 has slots at each corner of the tray 920, and the slots 920 are shaped to receive an insertable post or an insertable foot as previously discussed. The tray 920 may also have middle slots like the tray 937 of the first exemplary embodiment.

The topper 915 of the third exemplary embodiment of the modular food product display stand measures approximately 41.1 cm in length and 41.1 cm in width, and these measurements may differ, to approximately 41.5 cm in length and 41.5 cm in width, if the topper 915 is measured along the bottom of the topper sides because the topper sides may angle outward from the center of the topper 915. Further, because of the curved nature of the topper sides, the height of the topper 915 may range from approximately 3.5 cm to approximately 4.5 cm.

Like the topper of the first exemplary embodiment as shown in FIG. 6B, the topper 915 of the third exemplary embodiment has slots at each corner of the topper 915, and the slots are shaped to receive an insertable post, as previously discussed. The topper 915 may also have center slots, like the topper 935. The topper 315 also has slits along the border of the topper 315 for securing to other modular food product display stands, but these slits may differ in length and number as compared to the slits of topper 930.

In order to secure the square display stand 910 to the large rectangular display stand 930, stand clips 905 are attached to the slits of the toppers 915 and 935 in accordance with the principles earlier disclosed. The stand clips 905 are attached to different slits as compared to the slits for attaching the large rectangular display stand 930 to the small rectangular display stand 940. The inside set of slits are used for the stand clips 905 as compared to the outside set of slits, and the stand clips 905 are attached in this manner because the outside slits of topper 915 and the outside slits of topper 935 do not align properly for inserting the stand clips 805.

The large rectangular display stand 930 is connected to the small rectangular display 940 stand via stand clips 905, similar to how the two stands are connected in FIG. 7B.

All three stands 910, 930, and 940 may be combined in any manner or arrangement pursuant to the disclosed principles. Multiples of the different embodiments of the modular food product display stand may be combined together with other embodiments.

Figure 10:
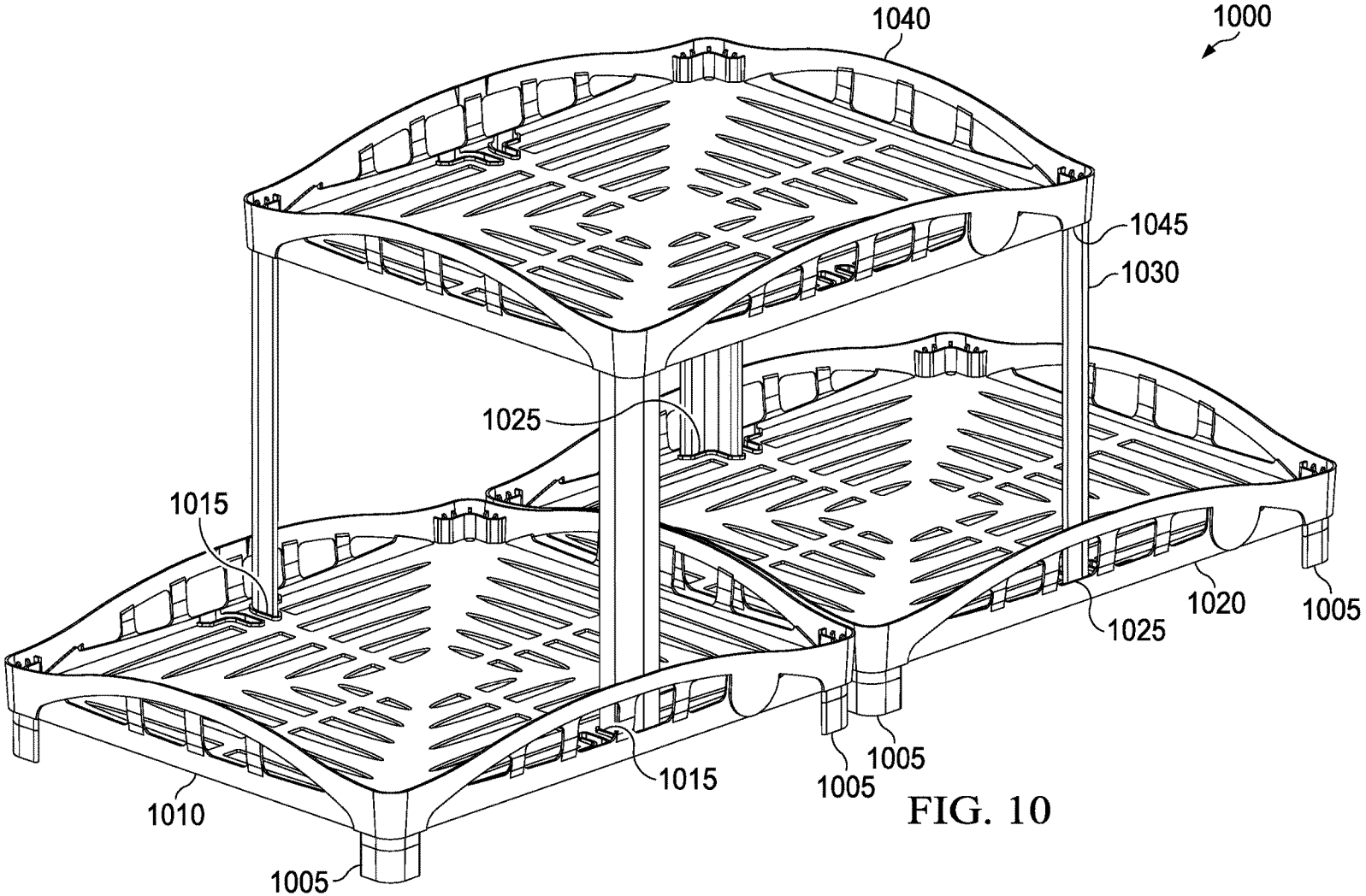
FIG. 10 is a perspective view of one embodiment of a modular food product display stand in accordance with the disclosed principles.

Referring now to FIG. 10, illustrated is a perspective view of an alternative embodiment of the modular food product display stand in accordance with the disclosed principles. The present alternative embodiment of the modular food product display stand 1000 utilizes the middle slots of the large rectangular tray of FIGS. 1A and 1B to create a pyramid food product display stand 1000. The pyramid food product display stand 1000 as illustrated in FIG. 10 comprises of two layers, but may be expanded to incorporate any number of layers and trays.

In order to construct the pyramid food product display stand as illustrated in FIG. 10, insertable feet 1005 are attached to a first tray 1010 and a second tray 1020, which are positioned next to each other. Four insertable posts 1030 are inserted into two middle slots 1015 of the first tray 1010 and two middle slots 1025 of the second tray 1020, and the four insertable posts 1030 are aligned with and inserted into the bottom slots 1045 of a third tray 1040. Optionally, a topper may be added to the pyramid food product display stand 1000.

The pyramid food product display stand 1000 may be expanded to incorporate any number of trays and any number of layers. For example, the pyramid food product display stand 1000 may incorporate six trays: three trays for a bottom layer, two trays for a middle layer, and one tray for a top layer. The pyramid food product display stand 1000 may be arranged in any manner and in any combination of trays.

Figure 11:
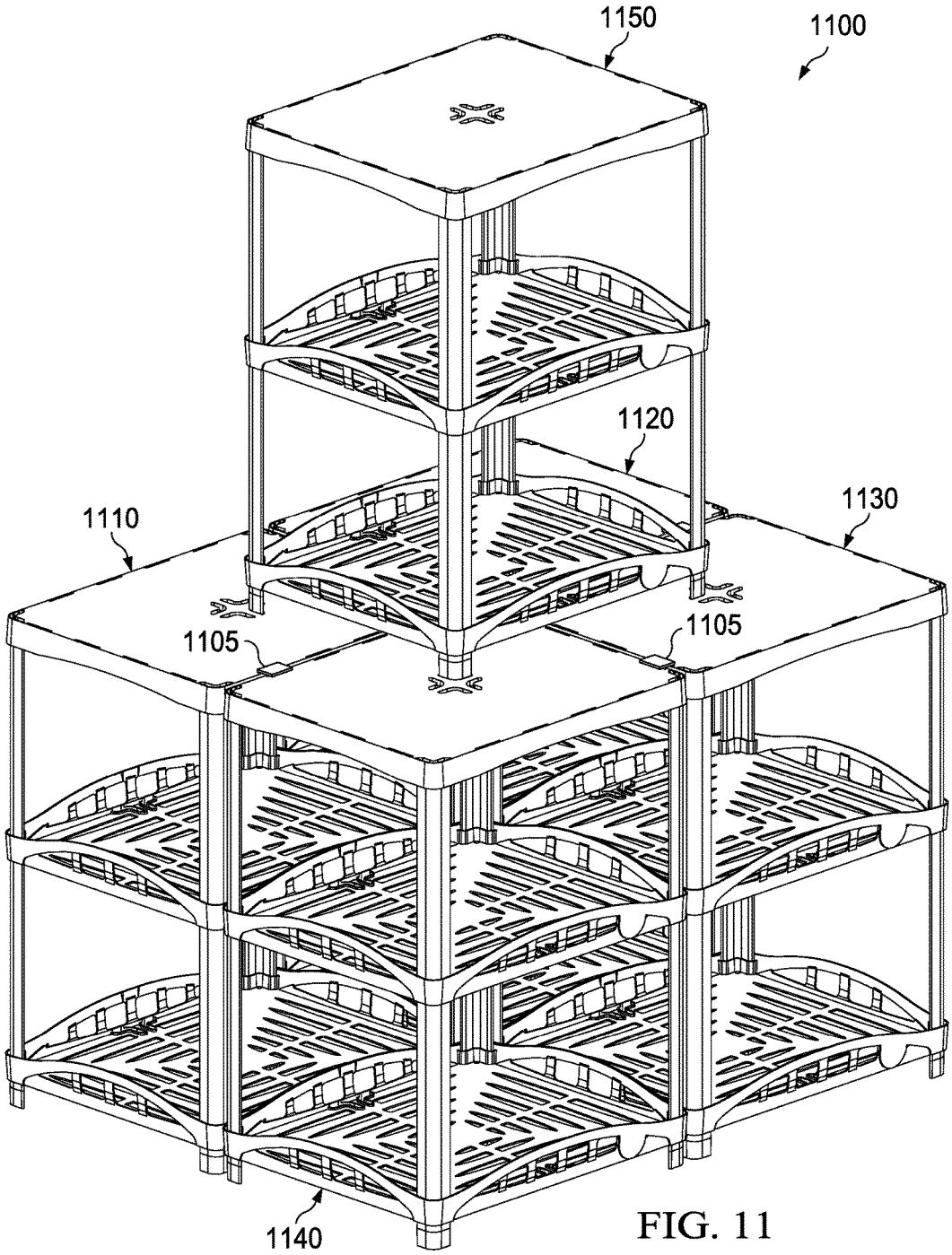
FIG. 11 is a perspective view of one embodiment of multiple food product display stands jointed together in accordance with the disclosed principles.

Referring now to FIG. 11, illustrated is a perspective view of multiple modular food product display stands secured together in accordance with the disclosed principles. FIG. 11 illustrates multiple modular food product displays stand secured together as a display stand tower 1100. The display stand tower 1100 as shown in FIG. 11 comprises five display stands: one display stand 1150 sitting on top of four other display stands 1110, 1120, 1130, and 1140. Although the display stand tower 1100 may be constructed with different embodiments of the modular food product display stand, the display stand tower 1100 is preferably constructed with modular food product display stands of a single design or embodiment. For example, the display stand tower 1100 of FIG. 11 is constructed of large rectangular display stands (the first exemplary embodiment of the modular food product display stand).

The four base display stands 1110, 1120, 1130, and 1140 are connected together via stand clips 1105. The stand clips 1105 are attached to various sets of slits of the display stands 1110, 1120, 1130, and 1140. The stand clips 1105 are designed to secure all four display stands 1110, 1120, 1130, and 1140 together as a base for the uppermost display stand 1150.

The uppermost display stand 1150 is a fully constructed modular food product display stand with insertable feet, and may comprise all the same components as the base display stands 1110, 1120, 1130, and 1140. To attach the uppermost display stand to the top of the base display stands 1110, 1120, 1130, and 1140, the insertable feet are inserted into one of the center slots of the display stands 1110, 1120, 1130, and 1140.

Figure 12:
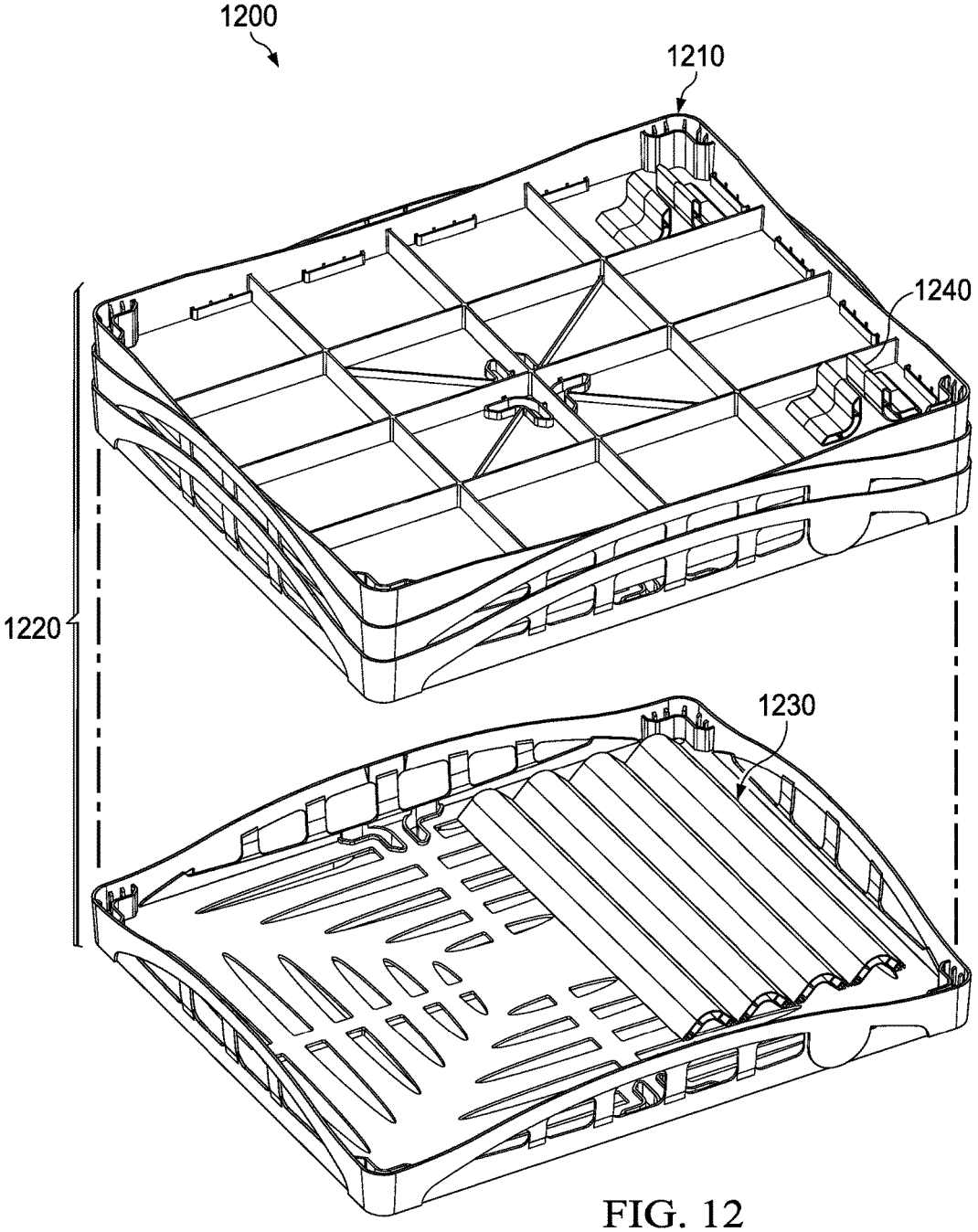
FIG. 12 is a perspective partial exploded view of one embodiment of the modular food product display stand unassembled in accordance with the disclosed principles.

The display stand tower 1100 may comprise any combination and number of modular food product display stands FIG. 12 is a perspective partial exploded view of one embodiment of the modular food product display stand unassembled in accordance with the disclosed principles. The unassembled modular food product display stand may comprise any number of plastic trays, a topper, any number of insertable plastic posts corresponding to the number of plastic trays, and at least four insertable plastic feet. In the present exemplary embodiment of the unassembled modular food product display stand of FIG. 12, the unassembled modular food product display stand 1200 comprises three plastic trays 1220, a plastic topper 1210, plastic posts 1230, and plastic feet 1240.

The unassembled modular food product display stand 1200 may come packaged and unassembled as shown in FIG. 12. The design of the trays 1220 of the modular food product display stand 1200 allows for the trays 1220 to be stacked on each other while reducing the overall height of the stack of trays 1220, so the trays nest inside each other. The stack of trays 1220 does not equal to the sum of the height of the trays 1220 because the trays 1220 sit on the inner walls of the top slots of the tray below, which has a smaller height than the height of the tray itself Similarly, the design of the topper 1210 of the modular food product display stand allows for the topper 1210 to be stacked on the inner walls of the top slots of the topmost tray. However, because of the size of the topper 1210, which is smaller than the trays 1220, additional trays are not meant to be stacked on top of the topper 1210, and therefore, the topper 1210 is meant to be on top of the unassembled modular food product display stand 1200, excluding the stand clips, plastic feet, and plastic posts.

FIG. 12 illustrates that the plastic feet and/or the plastic posts may be placed between the trays 1220 when the unassembled modular food product display stand 1200 is packaged together. In the present exemplary embodiment, each tray of the stack of trays 1220 holds at least four plastic posts 1230 before another tray with another four plastic posts is stacked on top, and by including four plastic posts 1230 with each tray, packaging and modification of the modular food product display stand 1200 is more organized and assists retail stores in assembling the modular food product display stand 1200. In another embodiment, twelve plastic posts placed on the bottom tray of the stack of trays 1220 before the rest of the trays are stacked on top.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes which come within the meaning and range of equivalency of the claims are therefore intended to be embraced therein. Further, the recitation of method steps does not denote a particular sequence for execution of the steps. Such method steps may therefore be performed in a sequence other than recited unless the particular claim expressly states otherwise.

What is claimed is:

1. A modular food product display stand, the display stand comprising:

a plastic tray, wherein said plastic tray has a top and a bottom, and the top of the plastic tray has four top corners; wherein further the bottom of the plastic tray has four bottom corners; wherein a top receiving slot is located at each top corner and a bottom receiving slot is located at each bottom corner;

four insertable plastic feet installed in the bottom receiving slots of the plastic tray, wherein outer dimensions of a cross section of the plastic feet match inner dimensions of a cross-section of the bottom receiving slots;

four insertable plastic posts installed in the top receiving slots of the plastic tray, wherein outer dimensions of a cross section of the plastic posts match inner dimensions of a cross-section of the top receiving slots, wherein the cross-section of the plastic posts substantially matches the cross-section of the plastic feet; wherein the plastic tray further comprises middle receiving slots, wherein inner dimensions of the middle receiving slots match the cross-section of the plastic posts, wherein the middle receiving slots are positioned adjacent to an edge of the plastic tray; and a plastic topper, wherein each corner of the bottom of the plastic topper comprises a receiving slot for receiving the plastic posts.

2. The modular food product display stand of claim 1, further comprising a plastic clip for attaching to the modular food product display stand to a second modular food product display stand.

3. The modular food product display stand of claim 2, wherein the plastic topper has a plurality of slits located on a border of the plastic topper, and wherein a leg of the plastic clip attaches to at least one of the plurality of slits.

4. The modular food product display stand of claim 1, wherein the plastic tray comprises polypropylene.

5. The modular food product display stand of claim 1, wherein the plastic topper comprises polypropylene.

6. The modular food product display stand of claim 1, wherein the insertable plastic feet comprise polypropylene.

7. The modular food product display stand of claim 1, wherein the insertable plastic posts comprise polypropylene.

8. The modular food product display stand of claim 1, wherein the plastic tray is injection molded.

9. The modular food product display stand of claim 1, wherein the plastic topper is injection molded.

10. The modular food product display stand of claim 1, wherein the plastic posts are extruded.

11. The modular food product display stand of claim 1, wherein the plastic posts are injection molded.

12. The modular food product display stand of claim 1, wherein the insertable plastic feet are extruded.

13. The modular food product display stand of claim 1, wherein the insertable plastic feet are injection molded.

14. The modular food product display stand of claim 1, wherein at least one post of the four insertable plastic posts comprises an opening along the length of the at least one post.

15. The modular food product display stand of claim 1, wherein the plastic topper comprises center receiving slots, wherein the center receiving slots are positioned adjacent to the center of the plastic topper, wherein inner dimensions of the center receiving slots match dimensions of the cross-section of the insertable plastic feet.

16. The modular food product display stand of claim 1, wherein the plastic topper comprises a top receiving slot at each corner of the top of the topper, wherein inner dimensions of each top receiving slot matches the inner dimensions of each receiving slot on the bottom of the topper.

17. The modular food product display stand of claim 1, wherein the plastic posts are translucent.

18. The modular food product display stand of claim 1, wherein the plastic tray comprises sides that angle away from the center of the plastic tray.

19. The modular food product display stand of claim 18, wherein the sides of the plastic tray angle 4 degrees away from a plane perpendicular to the plastic tray.

20. The modular food product display stand of claim 1, wherein the plastic topper comprises sides that angle away from the center of the tray.

21. The modular food product display stand of claim 20, wherein the sides of the plastic topper angle 4 degrees away from a plane perpendicular to the plastic topper.

22. A modular food product display stand, the display stand comprising:

a plurality of plastic trays, each comprising a plurality of corners of a top of each plastic tray, wherein each corner form top receiving slots; wherein further each plastic tray has a matching bottom receiving slot at each corner of a bottom of the tray to form bottom receiving slots, wherein further each plastic tray has a first set of middle receiving slots positioned adjacent to a first edge of the plastic tray and a second set of middle receiving slots positioned adjacent to a second edge of the plastic tray, wherein the first edge is parallel to the second edge;

a plurality of insertable plastic posts, wherein outer dimensions of a cross-section of the plastic posts match inner dimensions of the top receiving slots;

a plurality of insertable plastic feet, wherein outer dimensions of a cross-section of the plastic feet match inner dimensions of the bottom receiving slots;

wherein a first subset of plastic trays are positioned adjacent to each other to form a base layer of plastic trays, wherein the plurality of insertable plastic feet are installed into the bottom receiving slots of the first subset of plastic trays;

a first subset of plastic posts are installed into at least one of the first set of middle receiving slots of each plastic tray of the first subset of plastic trays and into at least one of the second set of middle receiving slots of each plastic tray of the first subset of plastic trays, wherein installation of the first subset of plastic posts comprises inserting a first end of a first plastic post of the first subset of plastic posts into the at least one of the first set of middle receiving slots and inserting a first end of a second plastic post of the first subset of plastic posts into the at least one of the second set of middle receiving slots;

a second end of each of the first subset of plastic posts is inserted into each bottom receiving slot of each plastic tray of a second subset of plastic trays.

23. The modular food product display stand of claim 22, wherein each tray of the plurality of plastic trays comprises sides that angle away from the center of each tray.

24. The modular food product display stand of claim 23, wherein the sides of each tray of the plurality of plastic trays angle 4 degrees away from a plane perpendicular to the tray.

25. The modular food product display stand of claim 23, wherein the sides of each tray of the plurality of plastic tray include handles.

26. The modular food product display stand of claim 22, wherein each tray of the plurality of trays is able to nest on top of another tray of the plurality of trays.

27. The modular food product display stand of claim 22, further comprising a plastic topper with a plurality of receiving slots, wherein each of the plurality of receiving slots are located at a corner of the bottom of the plastic topper.

28. The modular food product display stand of claim 27, wherein:

a second subset of plastic posts are installed into the top receiving slots of the second subset of plastic trays, wherein installation of the second subset of plastic posts comprises inserting a first end of each of the second subset of plastic posts into each of the top receiving slots of each plastic tray of the second subset of plastic trays; and a second end of each of the second subset of plastic posts is inserted into each receiving slot of the plastic topper.

29. The modular food product display stand of claim 27, wherein the plastic topper comprises center receiving slots, wherein the center receiving slots are positioned adjacent to the center of the plastic topper.

30. The modular food product display stand of claim 27, wherein the plastic topper comprises a plurality of corners, wherein each corner of the top of the topper comprises a top receiving slot.

31. The modular food product display stand of claim 22, further comprising a plastic clip for attaching to the modular food product display stand to a second modular food product display stand.

32. The modular food product display stand of claim 31, wherein the plastic topper has a plurality of slits located on a border of the plastic topper, and wherein a leg of the plastic clip attaches to at least one of the plurality of slits.

33. The modular food product display stand of claim 22, wherein at least one post of the plurality of insertable plastic posts comprises an opening along the length of the at least one post.

34. A method of assembling a modular food product display stand, wherein said modular food product display stand comprises a first plastic tray, having a top and a bottom, and the top of the first plastic tray has four top corners; wherein the bottom of the first plastic tray has four bottom corners; wherein a top receiving slot is located at each top corner; wherein further a bottom receiving slot is located at each bottom corner;

wherein said modular food product display stand further comprises four insertable plastic feet configured to be installed in the bottom receiving slots of the first plastic tray, wherein outer dimension of a cross section of the plastic feet match inner dimensions of a cross-section of the bottom receiving slots;

wherein said modular food product further comprises four insertable plastic posts configured to be installed in the top receiving slots of the first plastic tray, wherein outer dimensions of a cross section of the plastic posts match inner dimensions of a cross-section of the top receiving slots, wherein the cross-section of the plastic posts substantially matches the cross-section of the plastic feet; wherein the first plastic tray comprises middle receiving slots, wherein inner dimensions of the middle receiving slots match the cross-section of the plastic posts, wherein the middle receiving slots are positioned adjacent to an edge of the first plastic tray; and wherein said modular food product display stand further comprises a plastic topper, wherein said plastic topper comprises a plurality of corners, wherein each of the plurality of corners comprise a receiving slot disposed at the bottom of the plastic topper;

said method comprising:

inserting a first end of each of the four insertable plastic posts into one of the top receiving slots of the first plastic tray;

aligning a second end of each of the four insertable plastic posts to one of the receiving slots of the plastic topper; and inserting the second end of each of the four insertable plastic posts into the receiving slots of the plastic topper.

35. The method of claim 34, wherein said modular food product display stand further comprises a second plastic tray, wherein said second plastic tray has a top receiving slot at each corner of the second tray, said plastic tray has a matching receiving slot at each corner of the bottom of the second tray; wherein said modular food product display stand further comprises a second set of insertable plastic posts, wherein outer dimensions of the second set of plastic posts matches inner dimensions of the bottom receiving slots of the first plastic tray; the method further comprising:

inserting a first end of each of the second set of insertable plastic posts into one of the top receiving slots of the second plastic tray;

aligning a second end of each of the second set of insertable plastic posts to one of the bottom receiving slots of the first plastic tray; and inserting the second end of each of the second set of insertable plastic posts into the bottom receiving slots of the first plastic tray.

36. The method of claim 34, wherein said modular food product display stand further comprises a molded plastic clip for attaching said modular food product display stand to a second modular food product display stand.

37. The method of claim 34, wherein the topper has a center receiving slot, wherein dimensions of the center receiving slot matches the outer dimensions of the plastic posts.

38. The method of claim 34, wherein the first plastic tray comprises polypropylene.

39. The method of claim 34, wherein the first plastic tray is injection molded.

40. The method of claim 34, wherein the plastic posts are extruded.

41. The method of claim 34, wherein the plastic posts are injection molded.

42. The method of claim 34, wherein the insertable plastic feet are extruded.

43. The method of claim 34, wherein the insertable plastic feet are injection molded.

44. The modular food product display stand of claim 1, wherein the middle receiving slots are positioned in contact with the edge of the plastic tray.

45. The modular food product display stand of claim 1, wherein the middle receiving slots comprise raised lips configured to increase the depth of the middle slots.

* * * * *